US007914695B2

(12) United States Patent
Satsu et al.

(10) Patent No.: US 7,914,695 B2
(45) Date of Patent: Mar. 29, 2011

(54) MAGNET USING BINDING AGENT AND METHOD OF MANUFACTURING THE SAME

(75) Inventors: Yuichi Satsu, Hitachi (JP); Matahiro Komuro, Hitachi (JP); Takao Imagawa, Mito (JP); Takashi Yasuhara, Yotsukaido (JP); Yutaka Matsunobu, Mito (JP)

(73) Assignee: Hitachi, Ltd., Tokyo (JP)

( * ) Notice: Subject to any disclaimer, the term of this patent is extended or adjusted under 35 U.S.C. 154(b) by 1013 days.

(21) Appl. No.: 11/684,889

(22) Filed: Mar. 12, 2007

(65) Prior Publication Data

US 2007/0209737 A1 Sep. 13, 2007

(30) Foreign Application Priority Data

Mar. 13, 2006 (JP) ..... 2006-066883
Feb. 28, 2007 (JP) ..... 2007-048358

(51) Int. Cl.
*H01F 1/08* (2006.01)

(52) U.S. Cl. ..... 252/62.55; 148/302; 148/101; 148/122; 428/702; 428/323; 428/402; 428/403; 428/407; 428/692.3

(58) Field of Classification Search ..... 252/62.55; 148/302, 101, 122; 428/702, 323, 402, 403, 428/692.3
See application file for complete search history.

(56) References Cited

U.S. PATENT DOCUMENTS 5,464,576 A 11/1995 Yamashita et al.
6,054,219 A * 4/2000 Satsu et al. ..... 428/403
2002/0043301 A1 4/2002 Walmer et al.
2002/0084440 A1 7/2002 Ohmori et al.
2006/0022175 A1 2/2006 Komuro et al.
2006/0222848 A1* 10/2006 Satsu et al. ..... 428/403

FOREIGN PATENT DOCUMENTS

JP 59-136908 * 8/1984
JP 59-136908 A 8/1984
JP 64-14902 A 1/1989
JP 6-69009 A 3/1994
JP 8-115809 A 5/1996
JP 8-311501 A 11/1996
JP 10-154613 A 6/1998
JP 10-208919 A 8/1998
JP 10-321427 * 12/1998
JP 10-321427 A 12/1998
JP 11-67514 A 3/1999

(Continued)

OTHER PUBLICATIONS

Derwent abstract for JP 59-136908.*
Translation for JP 10-321427.*

(Continued)

*Primary Examiner* — C. Melissa Koslow
(74) *Attorney, Agent, or Firm* — Crowell & Moring LLP

(57) ABSTRACT

The object of the present invention is to both reduce costs and improve magnetic characteristics of rare-earth bond magnets in which magnetic material is bound with a binding agent. In order to achieve this object, magnetic characteristics of a magnet are improved by performing cold forming on rare-earth magnetic powder by itself with no resin added. Then, in order to provide strength for the magnet, a low-viscosity $SiO_2$ precursor is infiltrated and thermoset in the magnet shaped body. As a result, it is possible to obtain a rare-earth bond magnet in which magnetic characteristics are improved and costs are reduced.

16 Claims, 3 Drawing Sheets

FOREIGN PATENT DOCUMENTS

| | | | |
|---|---|---|---|
| JP | 11-23860 | A | 8/1999 |
| JP | 2000-58312 | A | 2/2000 |
| JP | 2000-309802 | A | 11/2000 |
| JP | 2004-172381 | A | 6/2004 |
| JP | 2005-286315 | A | 10/2005 |
| JP | 2006-66870 | A | 3/2006 |

OTHER PUBLICATIONS

European Search Report dated Dec. 8, 2009 (Six (6) pages).
Chinese Office Action w/English Translation dated Jun. 27, 2008 (Nine (9) pages).
Japanese Office Action mailed Nov. 2, 2010 (three (3) sheets).

* cited by examiner (a)

×500

(b)

ELEMENT ANALYSIS : O

×500

(c)

ELEMENT ANALYSIS : Si

×500

MAGNET USING BINDING AGENT AND METHOD OF MANUFACTURING THE SAME

FIELD OF THE INVENTION

The present invention relates to a magnet using binding agent and method of manufacturing the same.

BACKGROUND OF THE INVENTION

The characteristics of permanent magnets have improved significantly in recent years. An example of widely used permanent magnet is a sintered magnet made by sintering a magnetic material. Sintered magnets provide superior characteristics as magnets, but there are many productivity problems associated with the manufacture of sintered magnets.

Research has been done on sintered magnets as well as magnets in which magnetic material has been solidified with resin. With these magnets, mechanical strength is obtained by binding magnetic material with thermosetting epoxy resin. However, the deterioration of magnetic characteristics in magnets that use epoxy resin is a current problem, and adequate magnetic characteristics have not been achieved.

Patent Documents 1 through 3 below describe magnets that use epoxy resin. These patent documents describe technologies for improving magnetic characteristics and the like.

Patent Document 4 provides a different binding agent from epoxy resin and describes a magnet in which rare-earth magnetic powder particles are bound with $SiO_2$ and/or $Al_2O_3$. Also, Patent Document 5 describes an inorganic bond magnet filled with an oxide glass material in which fine oxide magnetic particles are dispersed.

(Patent Document 1) JP-A-11-238640
(Patent Document 2) JP-A-11-067514
(Patent Document 3) JP-A-10-208919
(Patent Document 4) JP-A-10-321427
(Patent Document 5) JP-A-8-115809

A problem associated with conventional magnets that use epoxy resin as a binding agent is that when compression molding of a mixture of magnetic material and epoxy resin is performed, the epoxy resin pushes away magnetic particles, making it difficult to improve the amount of magnetic particles that can be used to fill the mixture. As a result, superior characteristics are difficult to obtain with magnets that use epoxy resin as the binder.

The object of the present invention is to provide a magnet in which magnet material is bound with a binding agent in which the magnetic characteristics are improved, and a method for making the same.

DETAILED DESCRIPTION OF THE INVENTION

The present invention achieves the objects described above by at least one of the following characteristics.

According to one aspect of the present invention, a magnetic material is bound using a binding agent in which the precursor solution thereof has good wettability with magnetic material.

According to another aspect of the present invention, $SiO_2$ is used as the binding agent in which the precursor solution has good wettability with magnetic material, and $SiO_2$ is used to bind magnetic material.

Another aspect of the present invention relates to a method for manufacturing a binding agent specific to the present application. More specifically, alkoxy group remains under certain conditions for manufacturing a binding agent, and in addition to the $SiO_2$ described above, alkoxy group is also present in the binding agent that is finally produced.

According to yet another aspect of the present invention, a magnetic material powder is shaped, and a binding agent solution having good wettability with the magnetic powder shaped body is infiltrated to bind the shaped magnetic powder.

Other objects, features and advantages of the invention will become apparent from the following description of the embodiments of the invention taken in conjunction with the accompanying drawings.

The present invention includes other characteristics, and these will be described in the embodiments.

Figure 1:
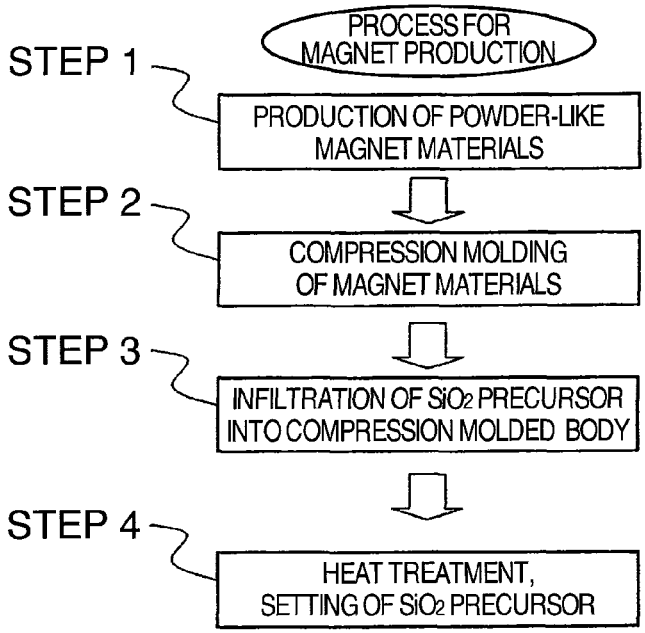
FIG. 1 describes the process for producing magnets and relates to the method for producing without insulating film treatment.

FIG. 1 shows an example of a manufacturing process of the magnet according to the present invention. In step 1, a powdered magnet material is formed. The detailed forming methods will be described in the examples presented later.

In step 2, compression molding is performed on the powdered magnet material. If, for example, a permanent magnet for a rotating device is to be made, the compression molding can be performed according to the final magnet shape of the permanent magnet to be used in the rotating device. With the method described in detail below, the dimensions of the magnet shape that is compression molded at step 2 do not change much in subsequent steps. As a result, a highly precise magnet can be manufactured. This increases the possibilities for achieving the precision demanded for the permanent magnet rotating device. For example, it would be possible to obtain the precision needed for a magnet to be used in a rotating device with an internal permanent magnet. In contrast, conventional sintered magnets provide very bad dimensional precision in the manufactured magnets, requiring cutting of the magnet. This reduces operation efficiency while also possibly leading to degradation of the magnetic characteristics by the cutting operation.

In step 3, the $SiO_2$ precursor solution is infiltrated in the compression molded magnet shaped body. This precursor is a material having good wettability with the magnet shaped body that was compression molded. By impregnating with a binding agent solution having good wettability with the magnet shaped body, the binding agent covers the surface of the magnetic powder forming the magnet shaped body, acting to form effective bonds between a large number of the powders. Also, since the good wettability allows the binding agent solution to enter the fine areas of the magnet shaped body, good bonding can be achieved with a small quantity of binding agent. Also, since good wettability is involved, the equipment used is more simple and inexpensive compared to the use of epoxy resin.

In step 4, the shaped body is heated to obtain a magnet in which the magnet material is bonded with $SiO_2$ as a binding agent. As described in detail below, the processing temperature at step 4 is relatively low, resulting in almost no changes in the shape or the dimensions of the magnet shaped body, thus eventually providing a very high degree of precision in the shape and relative dimensions of the manufactured magnet.

Examples of alkoxysiloxane and alkoxysilane, which are precursors of $SiO_2$ used in the binding agent solution used in step 3 include compounds such as those shown in chemical formula 2 and chemical formula 3 in which there is an alkoxy group at the terminal group or the side chain.

[Formula 2]

Chemical formula 2

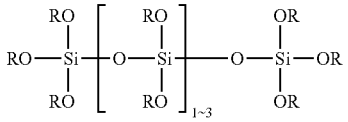

R = Me, Et, n-Pr, i-Pr

[Formula 3]

Chemical formula 3

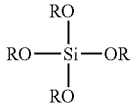

R = Me, Et, n-Pr, i-Pr

As an alcohol in the solvent, it would be preferable to use a compound with the same skeleton as the alkoxy group in the alkoxysiloxane or the alkoxysilane, but the present invention is not restricted to this. More specifically, examples include methanol, ethanol, propanol, and isopropanol. Also, as a catalyst for hydrolysis and dehydration condensation, an acid catalyst, a base catalyst, or a neutral catalyst can be used, but it would be most preferable to use a neutral catalyst since it is possible to minimize corrosion of metal. For neutral catalysts, organotin catalysts are effective. Specific examples include bis(2-ethyl hexanoate) tin, n-butyl tris(2-ethyl hexanoate) tin, di-n-butyl bis(2-ethyl hexanoate) tin, di-n-butyl bis(2,4-pentanedionate) tin, di-n-butyl dilauryl tin, di-methyl di-neodecanoate tin, dioctyl dilauric acid tin, and dioctyl di-neodecanoate tin, but the present invention is not restricted to these. Also, examples of acid catalysts include diluted hydrochloric acid, diluted sulfuric acid, dilute nitric acid, formic acid, and acetic acid, and examples of base catalysts include sodium hydroxide, potassium hydroxide, and ammonia water. The present invention is not restricted to these examples.

It would be preferable for the total content of the alkoxysiloxane or the alkoxysilane, the hydrolysate thereof, and the dehydration condensation product thereof serving as the precursor for $SiO_2$ in the binding agent solution to be at least 5% by volume and no more than 96% by volume. If the total content of the alkoxysiloxane or the alkoxysilane, the hydrolysate thereof, and the dehydration condensation product thereof is less than 5% by volume, the low content of the binding agent in the magnet slightly reduces the strength of the binding agent as a material after setting. If, on the other hand, the total content of the alkoxysiloxane or the alkoxysilane, the hydrolysate thereof, and the dehydration condensation product thereof is 96% by volume or more, the rate of the polymerization reaction of the alkoxysiloxane or alkoxysilane as the precursor for $SiO_2$ is fast, resulting in an increased thickening rate for the binding agent solution. This makes controlling the viscosity of the binding agent solution to be an appropriate value difficult, and makes the use of this binding agent solution in impregnation more difficult than the aforementioned material.

The alkoxysiloxane or the alkoxysilane serving as the precursor for $SiO_2$ in the binding agent solution and water results in the hydrolysis reaction indicated in chemical equation 4 or chemical equation 5. The chemical equations here are the equations for reactions that take place where there is localized hydrolysis.

[Formula 4]

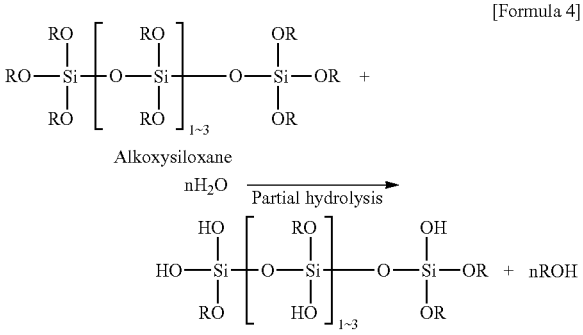

Chemical formula 4

[Formula 5]

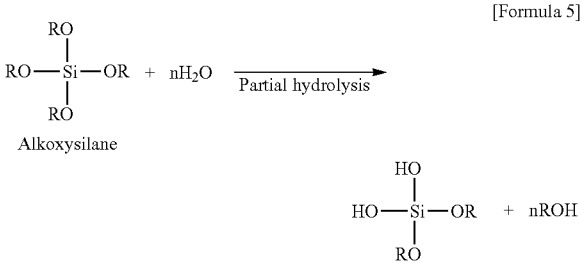

Chemical formula 5

The amount of water added is one of the factors that dictate how the hydrolysis of alkoxysiloxane or alkoxysilane progresses. This hydrolysis is important for increasing the mechanical strength of the binding agent after setting. This is because without hydrolysis of alkoxysiloxane or alkoxysilane, there will be no subsequent dehydration condensation of the alkoxysiloxane or alkoxysilane hydrolysis reactants. The product of this dehydration condensation is $SiO_2$, and this $SiO_2$ has strong bonding with the magnetic particles and is an important material for increasing the mechanical strength of the binding agent. Furthermore, the OH group of silanol has a strong interaction with O atoms or the OH group of the magnetic powder surfaces and contributes to improved bonding. However, as the hydrolysis proceeds and the concentration of the silanol group increases, dehydration condensation between the organosilicon compounds containing the silanol group (the product of the hydrolysis of alkoxysiloxane or alkoxysilane) takes place, resulting in increased molecular weight of organosilicon compound and increased viscosity of the binding agent solution. This is not a suitable state for a binding agent solution to be used for the impregnation method. Thus, the amount of water added to the alkoxysiloxane or the alkoxysilane as the serving as the precursor for $SiO_2$ in the binding agent solution must be an appropriate value. It would be preferable for the amount of water to be added to the solution for forming the insulation layer to be 1/10-1 the reaction equivalent in the hydrolysis reaction indicated in Chemical Equation 1 and Chemical Equation 2. If the water added to the alkoxysiloxane or alkoxysilane as the precursor for $SiO_2$ in the binding agent solution is 1/10 the reaction equivalent or less of the hydrolysis reaction shown in Chemical Equation 1 or 2, the concentration of the silanol group of the organosilicon compound is lowered, resulting in low interaction between the organosilicon compound containing the silanol group and the magnetic powder surfaces. Also, since the dehydration condensation reaction is retarded, $SiO_2$ with a large amount of alkoxy group in the product is generated, resulting in a large number of defects in the $SiO_2$ and low strength for the $SiO_2$. If, on the other hand, the amount of water added is greater than the reaction equivalent of the hydrolysis reaction shown in Chemical Equation 1 or 2, dehydration condensation of the organosilicon compound containing the silanol group is made easier, resulting in thickening of the binding agent solution. This prevents the binding agent solution from being infiltrated into the gaps between magnet particles and is not an appropriate state for the binding agent solution to be used in the impregnation method. Alcohol is generally used as the solvent in the binding agent solution. This is because the alkoxy group in alkoxysiloxane dissociates quickly with the solvent used in the binding agent solution and replaces the alcohol solvent to maintain an equilibrium state. Thus, it would be preferable for the alcohol solvent to be an alcohol with a boiling point lower than that of water and with a low viscosity such as methanol, ethanol, n-propanol, or iso-propanol. However, the present invention can also use an aqueous solvent such as a ketone, e.g., acetone, even if chemical stability of the solution is slightly reduced as long as the viscosity of the binding agent solution does not increase in a few hours and the boiling point is lower than that of water.

The following characteristics can be described for an example of a binding agent according to the present invention as described above.

First, the $SiO_2$ precursor is formed as a solution with alcohol as a solvent. Water is added simply to adjust the hydrolysis reaction. By performing impregnation using a solution based on alcohol rather than an aqueous solution, almost no water remains after thermosetting. Since residual water in the permanent magnet is limited, magnetic characteristics do not degrade over time due to oxidation and the like.

Since hydrolysis is performed with alkoxysiloxane or alkoxysilane or the like as the $SiO_2$ precursor, there may be methoxy residue. In this case, in addition to the magnet particles and the binder binding the magnet particles, methoxy would be present in the manufactured permanent magnet.

Next, in the magnet created with the steps described above, rate-earth magnet particles, e.g., NdFeB, are bound with an SiO-based binder. This binder has an amorphous continuous-film structure. As described above, the binder is formed essentially from $SiO_2$, but since the structure is amorphous, it is possible for compositions such as SiO to be present in a localized manner. Thus, a binder can be considered to be a continuous film formed primarily from Si and O, i.e., an SiO-based continuous film.

Next, the use of oxide glass not based on SiO as binder will be considered. Performing the manufacturing steps of the present invention described above involves various requirements for the precursor serving as the impregnation solution, e.g., low viscosity, high permeability, high stability, and setting at a relatively low temperature. An SiO-based binder is considered to be optimal for meeting these requirements, but advantages can be expected by using other oxide glasses as binder if the requirements for these manufacturing steps are met.

Figure 2:
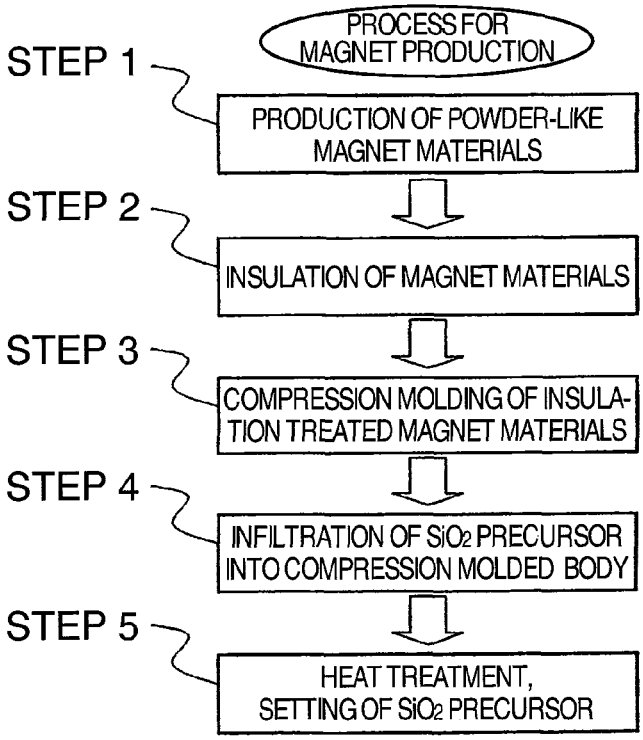
FIG. 2 describes the process for producing magnets and relates to the method for producing with insulating film treatment.

FIG. 2 shows another example of a magnet manufacturing process according to the present invention. This example differs from the one described with reference to FIG. 1 in that an insulating step is added after the creation of the powdered magnetic material and before compression molding.

In this insulating step, it would be preferable to form an insulating layer over as much of the surfaces of the magnet particles and as uniformly as possible. The details of the operation will be described later. If a magnet is to be used in different types of machines such as rotating devices, it will often be used in alternating current magnetic fields. For example, in a rotating device, magnetic flux generated by coils and acting upon a magnet changes periodically. When magnetic flux changes in this manner, eddy currents may be generated at the magnet, reducing the efficiency of the device used. Covering the magnet particle surfaces with an insulation layer can limit these eddy currents and can prevent the efficiency of the rotating device from being reduced.

In one embodiment, the insulative film is a phosphatized film. The phosphatized film can be formed from an aqueous solution containing phosphoric acid, boric acid, and at least one component selected from the group consisting of Mg, Zn, Mn, Cd, Ca, Sr, and Ba. The phosphatized film can also be formed from an aqueous solution containing phosphoric acid, boric acid, at least one component selected from the group consisting of Mg, Zn, Mn, Cd, Ca, Sr, and Ba, a surfactant, and an antirust agent.

When a magnet is used under the condition that it is applied with a high frequency magnetic field containing harmonic components, it is preferable that inorganic insulating film is formed on the surface of rare-earth magnet powder. Thus, it would be preferable for an inorganic insulative film to be formed on the rare-earth magnet particle surfaces and to form a phosphatized film as the inorganic insulative film. If phosphoric acid, magnesium, and boric acid are used for the phosphatization solution, the following composition would be preferable. A phosphoric acid content of 1-163 $g/dm^3$ would be preferable, since magnetic flux density would be reduced if the content is greater than 163 $g/dm^3$ and insulative properties would be reduced if the content is less than 1 $g/dm^3$. Also, it would be preferable for boric acid content to be 0.05-0.4 g per 1 g of phosphoric acid. If this range is exceeded, the insulative layer becomes unstable. To form an insulative layer uniformly over all the magnet particle surfaces, improving wettability of the insulative film forming solutions relative to the magnet particles would be effective. To achieve this, it would be preferable to add a surfactant. Examples of this type of surfactant include perfluoroalkyl-based surfactants, alkylbenzene sulfonate based surfactants, dipolar ion based surfactants, or polyether-based surfactants. It would be preferable for the amount added to be 0.01-1% by weight in the insulative layer forming solution. If the amount is less than 0.01% by weight, the surface tension is lowered and the wetting of the magnetic powder surface is inadequate. If the amount exceeds 1% by weight, no additional advantages are gained thus making it uneconomical.

An antirust agent can also be added to the phophatization solution. In one embodiment, the antirust agent is an organic compound containing at least one of sulfur and nitrogen with a lone-pair of electrons. In a particular embodiment, the organic compound containing at least one of sulfur and nitrogen with the lone-pair of electrons is a benzotriazole expressed by Chemical Formula 1:

[Formula 1] Chemical formula 1

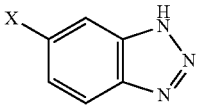

wherein X is any of H, $CH_3$, $C_2H_5$, $C_3H_7$, $NH_2$, OH, and COOH.

The coat film can contain at least one component selected from the group consisting of $MgF_2$, $CaF_2$, $SrF_2$, $BaF_2$, $LaF_3$, $CeF_3$, $PrF_3$, $SmF_3$, $EuF_3$, $GdF_3$, $TbF_3$, $DyF_3$, $HoF_3$, $ErF_3$, $TmF_3$, $YbF_3$, and $LuF_3$ as a rare-earth fluoride or an alkali-earth metal fluoride.

Also, it would be preferable for the amount for an antirust agent to be 0.01-0.5 mol/dm$^3$. If the amount is less than 0.01 mol/dm$^3$, it becomes difficult to prevent rust on the magnetic powder surfaces. If the amount exceeds 0.5 mol/dm$^3$, no additional advantages are gained thus making it uneconomical.

The amount of phosphatization solution added is dependent on the average particle diameter of the magnet particles for the rare-earth magnet. If the average particle diameter of the magnet particles for the rare-earth magnet is 0.1-500 microns, it would be preferable for the amount to be 300-25 ml for 1 kg of magnet particles for the rare-earth magnet. If the amount is greater than 300 ml, the insulative film on the magnet particle surface becomes too thick and also leads to increased rust formation, thus reducing the magnetic flux density when the magnet is manufactured. If the amount is less than 25 ml, the insulative properties are not good and rust tends to form where the processing solution does not wet, potentially leading to degradation in magnet characteristics.

The reason that rare-earth fluorides or alkali-earth metal fluorides in the coat film forming solution bloat in solvents having alcohol as the main component is that rare-earth fluoride or alkali-earth metal fluoride gel has a gelatinous plastic structure and that alcohol has good wettability with regard to magnetic powder for rare-earth magnets. Also, the rare-earth fluorides or alkali-earth metal fluorides in the gel state must be crushed to a average particle diameter of no more than 10 microns because this provides a uniform thickness for the coat film formed on the rare-earth magnetic powder surface. Furthermore, using alcohol as the main component for the solvent makes it possible to limit oxidation of the rare-earth magnetic powder, which tends to easily oxidize.

Furthermore, it would be preferable for the inorganic insulative film used to improve insulation properties and magnetic characteristics of the magnetic powder to be a fluoride coat film. When a fluoride coat film is formed on the rare-earth magnetic powder surface for these reasons, the concentration of the rare-earth fluoride or alkali-earth metal fluoride in the fluoride coat film forming solution is 200 g/dm$^3$ to 1 g/dm$^3$. While the concentration of the rare-earth fluoride or alkali-earth metal fluoride in the fluoride coat film forming solution is dependent on the thickness of the film to be formed on the rare-earth magnetic powder surface, it is important that the rare-earth fluoride or alkali-earth metal fluoride bloats in the solvent having alcohol as its main component and the rare-earth fluoride or alkali-earth metal fluoride in the gel state must be crushed to a average particle diameter of no more than 10 microns and be dispersed through the solvent having as alcohol as its main component.

The amount of rare-earth fluoride coat film forming solution added depends on the average particle diameter of the rare-earth magnetic powder. If the average particle diameter of the rare-earth magnetic powder is 0.1-500 microns, it would be preferable to add 300-10 ml for each kilogram of rare-earth magnetic powder. If the amount of solution is too high, more time is required to remove the solvent and also the rare-earth magnetic powder tends to corrode. If the amount of solution is too low, the solution may not wet parts of the rare-earth magnetic powder surface. Table 1 indicates effective concentrations for the solution and the like for the rare-earth fluoride or alkali-earth metal fluoride coat film as described above.

TABLE 1

| Component | Solution state | Effective concentration as a processing solution | Solvent | Average particle diameter |
|---|---|---|---|---|
| $MgF_2$ | Colorless, transparent, slightly viscous | ≦200 g/dm3 | Methanol | <100 nm |
| $CaF_2$ | Milky, slightly viscous | ≦200 g/dm3 | Methanol | <1000 nm |
| $LaF_3$ | Semitransparent, viscous | ≦200 g/dm3 | Methanol | <1000 nm |
| $LaF_3$ | Milky, slightly viscous | ≦200 g/dm3 | Ethanol | <2000 nm |
| $LaF_3$ | Milky | ≦200 g/dm3 | n-propanol | <3000 nm |
| $LaF_3$ | Milky | ≦200 g/dm3 | Iso-propanol | <5000 nm |
| $CaF_2$ | Viscous, milky | ≦100 g/dm3 | Methanol | <2000 nm |
| $PrF_3$ | Yellow-green, semitransparent, viscous | ≦100 g/dm3 | Methanol | <1000 nm |
| $NdF_3$ | Light purple, semitransparent, viscous | ≦200 g/dm3 | Methanol | <1000 nm |
| $SmF_3$ | Milky | ≦200 g/dm3 | Methanol | <5000 nm |
| $EuF_3$ | Milky | ≦200 g/dm3 | Methanol | <5000 nm |
| $GdF_3$ | Milky | ≦200 g/dm3 | Methanol | <5000 nm |
| $TbF_3$ | Milky | ≦200 g/dm3 | Methanol | <5000 nm |
| $DyF_3$ | Milky | ≦200 g/dm3 | Methanol | <5000 nm |
| $HoF_3$ | Pink, cloudy | ≦150 g/dm3 | Methanol | <5000 nm |
| $ErF_3$ | Pink, cloudy, slightly viscous | ≦200 g/dm3 | Methanol | <5000 nm |
| $TmF_3$ | Slightly semitransparent, viscous | ≦200 g/dm3 | Methanol | <1000 nm |
| $YbF_3$ | Slightly semitransparent, viscous | ≦200 g/dm3 | Methanol | <1000 nm |
| $LuF_3$ | Slightly semitransparent, viscous | ≦200 g/dm3 | Methanol | <1000 nm |

In one embodiment, a rare-earth magnet comprises a rare-earth magnetic powder bound with a $SiO_2$ binding agent containing an alkoxy group. In a particular embodiment, the rare-earth magnetic powder has an inorganic insulative film formed on its surfaces at a thickness of 10 microns -10 nm.

The above was a description of an example of a magnet manufacturing process according to the present invention, with references to FIG. 1 and FIG. 2. A more specific example will be described below.

EXAMPLE 1

In this example, the rare-earth magnetic powder used is a magnetic powder crushed from NdFeB-based ribbons made by quenching a hardener with a controlled composition. The NdFeB-based hardener is formed by mixing Nd in an iron and an Fe—B alloy (ferroboron) and melting in a vacuum or an inert gas or a reduction gas atmosphere to make the composition uniform. The hardener is cut as needed and a method involving a roller such as a single-roller or double-roller method is used and the hardener melted on the surface of a rotating roller is spray quenched in an atmosphere of reduction gas or inert gas such as argon gas to form ribbons, which are then heated in an atmosphere of reduction gas or inert gas. The heating temperature is at least 200° C. and no more than 700° C., and this heat treatment results in the growth of fine $Nd_2Fe_{14}B$ crystals. The ribbons have a thickness of 10-100 microns and the fine $Nd_2Fe_{14}B$ crystal sizes are 10 to 100 nm.

If the $Nd_2Fe_{14}B$ fine crystals have an average size of 30 nm, the grain boundary layer has a composition close to $Nd_{70}Fe_{30}$ and is thinner than critical particle diameter of a single magnetic domain, thus making the formation of a magnetic wall in the $Nd_2Fe_{14}B$ fine crystals difficult. It is believed that the magnetization of $Nd_2Fe_{14}B$ fine crystals occurs because the individual fine crystals are magnetically bonded and the inversion of magnetization takes place due to the propagation of magnetic walls. One method for limiting magnetization inversion is to make the magnetic particles crushed from ribbons more easy to magnetically bond with each other. To do this, making the non-magnetic sections between magnet particles as thin as possible is effective. The crushed powder is inserted into a WC carbide die with Co added. Then, the powder is compression molded with upper and lower punches at a press pressure of 5 t-20 t/cm$^2$, resulting in reduced non-magnetic sections between magnet particles in the direction perpendicular to the direction of the press. This is because the magnetic powders are flat powders formed by crushing ribbons, there is anisotropy in the arrangement of the flat powders of the compression molded shaped body. This results in the long axes of the flat powders (parallel to the direction perpendicular to the thickness of the ribbon) being aligned with the direction perpendicular to the press direction. Since the long axes of the flat powders tend to orient themselves perpendicular to the press direction, the magnetization in the shaped body is more continuous in the direction perpendicular to the press direction than in the press direction. This provides increased permeance between the particles and reduces magnetization inversion. As a result, there are differences in the demagnetization curves between the press direction and the direction perpendicular to the press direction in the shaped body. With a 10×10×10 mm shaped body, when magnetization is applied in the direction perpendicular to the press direction at 20 kOe and the demagnetization curve is measured, the residual magnetic flux density (Br) is 0.64 T and the coercivity (iHc) is 12.1 kOe. On the other hand, when 20 kOe magnetization is applied in the direction parallel to the press direction, a demagnetization curve measured in the magnetization direction shows a Br of 0.60 T and iHc of 11.8 kOe. This type of difference in demagnetization curves is believed to be due to the use of flat magnet particles used in the shaped body, with the orientation of the flat particles resulting in anisotropy within the shaped body.

This type of difference in demagnetization curves is believed to be due to the use of flat magnet particles used in the shaped body, with the orientation of the flat particles resulting in anisotropy within the shaped body. The grain size of the individual flat particles are small, at 10-100 nm, and there is little anisotropy in the crystal orientation, but since the shape of the flat particles have anisotropy, there is magnetic anisotropy due to the anisotropy of the orientation of the flat particles. Test samples of this type of shaped body were infiltrated with $SiO_2$ precursor solutions according to 1)-3) below and heat was applied. The steps that were performed are described below.

The following three solutions were used for the $SiO_2$ precursor, which is the binding agent.

1) A mixture of 5 ml of $CH_3O—(Si(CH_3O)_2—O)_m—CH_3$ (m is 3-5, average 4), 0.96 ml of water, 95 ml of dehydrated methanol, and 0.05 ml of dibutyltin dilaurate was prepared and left standing at a temperature of 25° C. for 2 days.

2) A mixture of 25 ml of $CH_3O—(Si(CH_3O)_2—O)_m—CH_3$ (m is 3-5, average 4), 4.8 ml of water, 75 ml of dehydrated methanol, and 0.05 ml of dibutyltin dilaurate was prepared and left standing at a temperature of 25° C. for 2 days.

3) A mixture of 100 ml of $CH_3O—(Si(CH_3O)_2—O)_m—CH_3$ (m is 3-5, average 4), 3.84 ml of water, and 0.05 ml of dibutyltin dilaurate was prepared and left standing at a temperature of 25° C. for 4 hours.

The viscosities of the $SiO_2$ precursor solutions described above were measured using an Ostwald viscometer at 30° C.

(1) Compression molded test pieces with 10 mm length, 10 mm width and 5 mm thickness for magnetic characteristic measurement and with 15 mm length, 10 mm width and 2 mm thickness for strength measurement were produced by filling molds with $Nd_2Fe_{14}B$ magnetic powder magnetic powder, described above, and applying pressure at 16 t/cm$^2$.

(2) The compression molded test pieces prepared in (1) were disposed in a vat so that the direction of pressure application was horizontal, and the binding agent, $SiO_2$ precursor solution from 1) through 3) described above were poured into the vat at a rate of liquid surface rising vertically 1 mm/min until reaching to 5 mm above the upper face of the compression molded test pieces.

(3) The vat from (2) containing the compression molded test pieces and filled with the $SiO_2$ precursor solution was set in a vacuum chamber, and the air was exhausted slowly to about 80 Pa. The vat was left standing until few bubbles were generated from the surface of the compression molded test pieces.

(4) Internal pressure of the vacuum chamber, in which the vat containing the compression molded test pieces and filled with the $SiO_2$ precursor solution was set, was slowly returned to atmospheric pressure, and the compression molded test pieces were taken out of the $SiO_2$ precursor solution.

(5) The compression molded test pieces that had been infiltrated with the $SiO_2$ precursor solutions prepared in (4) described above were set in a vacuum drying oven and vacuum heat-treated under the conditions of a pressure of 1-3 Pa and a temperature of 150° C.

(6) The specific resistances of the compression molded test pieces with 10 mm length, 10 mm width and 5 mm thickness that were produced in (5) described above were measured by the 4 probe method.

(7) Further, a pulse magnetic field of 30 kOe or above was applied to the compression molded test pieces, which were subjected to the specific resistance measurement as described above, and the magnetic characteristic of the compression molded test piece was investigated.

(8) A mechanical bending test was conducted using the compression molded test pieces with 15 mm length, 10 mm width and 2 mm thickness that were produced in (5). Samples of the compression molded pieces with a form of 15 mm×10 mm×2 mm were subjected to bending tests to evaluate flexural strength by 3 points bending tests with 12 mm distance between the points.

Figure 3:
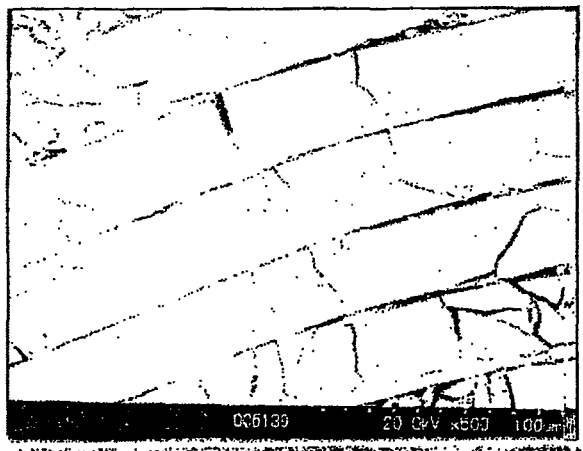
FIG. 3 shows the results of SEM observation of the sectional view of the bond magnet test piece of the magnet produced in the first Embodiment in which the binding agent was produced by infiltration and heat treatment of the $SiO_2$ precursor: (a) is a secondary electron image, (b) is an oxygen-surface analysis image and (c) is a silicon-surface analysis image.
Figure 3:
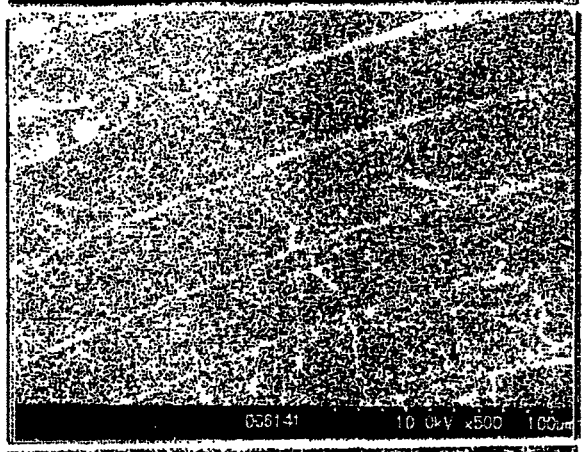
Figure 3:
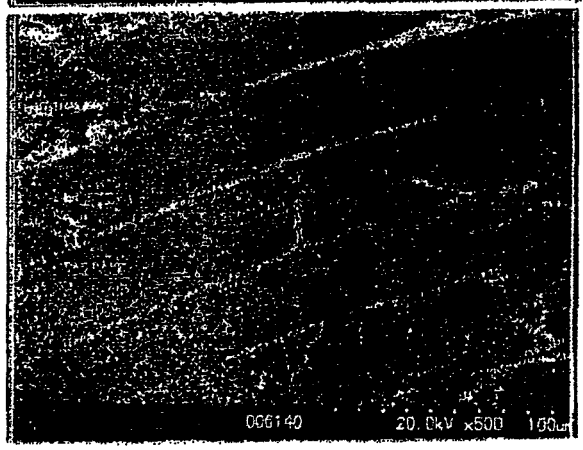

FIG. 3 shows an example of SEM observation results of cross-sections of compression molded test pieces with 10 mm length, 10 mm width and 5 mm thickness prepared in (5) above. FIG. 3 (*a*) is a secondary electron image, FIG. 3 (*b*) is an oxygen surface analysis image, and FIG. 3 (*c*) is a silicon surface analysis image. As FIG. 3 (*a*) shows, the flat particles are deposited with anisotropy and localized cracks are formed. Also, oxygen and silicon were detected along the crack at the flat particle surfaces and inside the flat particles. These cracks were formed during compression molding and were hollow before infiltration. Based on this, it was determined that the $SiO_2$ precursor solution infiltrated all the way into cracks of the magnet particles.

Regarding the magnetic characteristics of the compression molded test pieces with 10 mm length, 10 mm width and 5 mm thickness prepared in (5), there could be a 20-30% improvement in residual magnetic flux density compared to a bond magnet containing resin (comparative example 1). Regarding the demagnetization curve measured at 20° C., the residual magnetic flux density and coercivity values were roughly the same for shaped bodies before $SiO_2$ infiltration and after $SiO_2$ infiltration and heating. Also, the heat demagnetization rate after 1 hour in a 200° C. atmosphere was 3.0% for $SiO_2$ infiltrated bond magnets which was less than the heat demagnetization rate with no $SiO_2$ infiltration (5%). Furthermore, the irreversible heat demagnetization rate after treating the magnet at 200° C. for 1 hour, cooling to room temperature and then remagnetizing was less than 1% in the infiltration heat-treated magnet, while it was nearly 3% in the epoxy-based bond magnet (comparative example 1). This was because infiltration allowed the powder surfaces with cracks to be protected by the $SiO_2$, thus limiting corrosion such as oxidation and reducing the irreversible heat demagnetization rate. In other words, since powder surfaces containing cracks were protected by the infiltration of the $SiO_2$ precursor, corrosion from oxidation and the like was limited, and the irreversible heat demagnetization rate was reduced. Not only was the irreversible heat demagnetization rate limited, but the infiltrated magnets showed less demagnetization in PCT tests and salt-spray tests as well.

The compression molded test pieces with 10 mm length, 10 mm width and 5 mm thickness that were produced in (5) were kept in a 225° C. atmosphere for 1 hour and the demagnetization curve was measured after cooling at 20° C. The direction of application of the magnetic field was in the 10 mm direction, and the demagnetization curve was measured by initially applying a magnetic field of +20 kOe and then applying alternating positive and negative magnetic fields from ±1 kOe to ±10 kOe.

Figure 4:
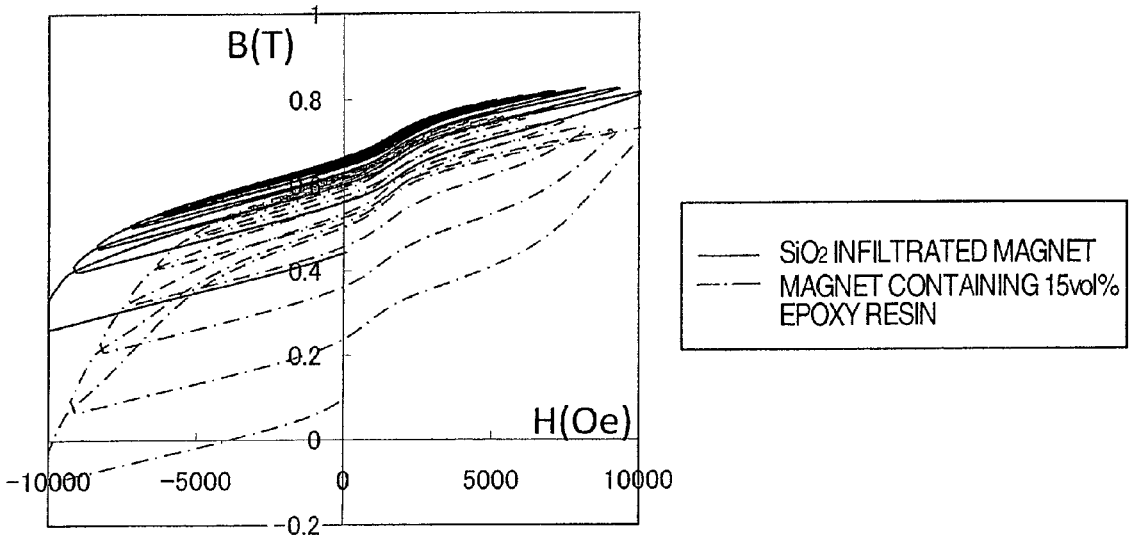
FIG. 4 shows the result of demagnetizing curve which was measured at 20° C. in compression molded test pieces with 10 mm length, 10 mm width and 5 mm thick kept at 225° C. for 1 hour under the atmosphere and then cooled. The measurements were conducted on the $SiO_2$ precursor infiltrated bond magnet of the present invention and the resin containing bond magnet. The magnetic field was impressed to the 10 mm direction. This is a result of the demagnetization curve measurement by first applying magnetic field of +20 kOe and after the magnetization, applying magnetic field of +1 kOe to +10 kOe with alternating plus and minus magnetic field.

The results are shown in FIG. 4. In this figure, demagnetization curves are compared between the infiltrated magnets prepared under the conditions indicated in 2) above and compression molded bond magnets containing epoxy resin as a binder at 15% by volume, described later. The horizontal axis in FIG. 4 indicates the applied magnetic field and the vertical axis indicates the residual magnetic flux density. When a magnetic field greater on the negative side than −8 kOe is applied, the infiltrated magnets show a sudden drop in magnetic flux. The compression molded bond magnets show a sudden drop in magnetic flux at a magnetic field value with an absolute value lower than that of the infiltrated magnets, with significant magnetic flux decline at magnetic fields greater on the negative side than −5 kOe. The residual magnetic flux density after application of a magnetic field of −10 kOe was 0.44 for the infiltrated magnets and 0.11 T for the compression molded bond magnets, with the residual magnetic flux density of the infiltrated magnets having a value 4 times that of the compression molded bond magnets. This is believed to be due to reduction in the magnetic anisotropy of the NdFeB crystals in the NdFeB particles resulting from oxidation on the surfaces of the NdFeB particles and crack surfaces of the NdFeB particles during heating at 225° C., thus resulting in a reduction in coercivity and a tendency for inversion in magnetization when a negative magnetic field is applied. In contrast, with the infiltrated magnets, the NdFeB particles and the crack surfaces are coated by $SiO_2$ film, thus preventing oxidation during heating in an atmosphere and reducing the drop in coercivity.

The flexural strength of the compression molded test pieces with 15 mm length, 10 mm width and 2 mm thickness prepared in (7) was no more than 2 MPa before infiltration with $SiO_2$, but it became at least 30 MPa after $SiO_2$ infiltration and heating. When the $SiO_2$ precursor solutions in 2) and 3) of this example were used, it was possible to manufacture magnetic shaped bodies with flexural strengths of 100 MPa or higher.

Regarding the specific resistance of the magnets, the magnets of the present invention had values that were approximately 10 times those of sintered rare-earth magnets but were approximately 1/10 the value of compression-type rare-earth bond magnets. However, this is not a problem since eddy current loss is low at least for use in standard motors of 10000 rotations or less.

Based on the results from this example, compared to standard rare-earth bond magnets containing resin, rare-earth bond magnets in which low-viscosity $SiO_2$ precursor of the present invention is infiltrated into a rare-earth magnet shaped body cold formed without resin according to the present invention showed an improvement of 20-30% magnetic characteristics, bend strengths in a range of a similar value to 3 times as high, a reduction in the irreversible heat demagnetization rate to half or less, and improved reliability of the magnet.

Table 2 summarizes the magnetic characteristics when binding agents 1)-3) were used for the present example as well as for (example 2)-(example 5), described later.

TABLE 2

Characteristics of magnets infiltrated with $SiO_2$ precursor material

| Binding agent | Binding agent composition: $SiO_2$ precursor material | Type of alcohol | Silicate compound (mL) | Water (mL) | Alcohol (mL) | Dibutyltin dilaurate (mL) |
|---|---|---|---|---|---|---|
| Example 1-1) | $CH_3O—(Si(CH_3O)_2—O)m—CH_3$, average m is 4 | Methanol | 5.0 | 0.96 | 95 | 0.05 |
| Example 1-2) | $CH_3O—(Si(CH_3O)_2—O)m—CH_3$, average m is 4 | Methanol | 25 | 4.8 | 75 | 0.05 |
| Example 1-3) | $CH_3O—(Si(CH_3O)_2—O)m—CH_3$, average m is 4 | Methanol | 100 | 3.84 | 0.0 | 0.05 |
| Example 2-1) | $CH_3O—(Si(CH_3O)_2—O)m—CH_3$, average m is 4 | Methanol | 25 | 0.96 | 75 | 0.05 |
| Example 2-2) | $CH_3O—(Si(CH_3O)_2—O)m—CH_3$, average m is 4 | Methanol | 25 | 4.8 | 75 | 0.05 |
| Example 2-3) | $CH_3O—(Si(CH_3O)_2—O)m—CH_3$, average m is 4 | Methanol | 25 | 9.6 | 75 | 0.05 |
| Example 3-1) | $CH_3O—Si(CH_3O)_2—OCH_3$ | Methanol | 25 | 5.9 | 75 | 0.05 |
| Example 3-2) | $CH_3O—(Si(CH_3O)_2—O)m—CH_3$, average m is 4 | Methanol | 25 | 4.8 | 75 | 0.05 |
| Example 3-3) | $CH_3O—(Si(CH_3O)_2—O)m—CH_3$, average m is 7 | Methanol | 25 | 4.6 | 75 | 0.05 |
| Example 4-1) | $CH_3O—Si(CH_3O)_2—OCH_3$ | Methanol | 25 | 5.9 | 75 | 0.05 |
| Example 4-2) | $C_2H_5O—Si(C_2H_5O)_2—OC_2H_5$ | Ethanol | 25 | 4.3 | 75 | 0.06 |
| Example 4-3) | $n\text{-}C_3H_7O—Si(n\text{-}C_3H_7O)_2—O\text{-}n\text{-}C_3H_7$ | Isopropanol | 25 | 3.4 | 75 | 0.05 |
| Example 5-1) | $CH_3O—(Si(CH_3O)_2—O)m—CH_3$, average m is 4 | Methanol | 25 | 9.6 | 75 | 0.05 |
| Example 5-2) | $CH_3O—(Si(CH_3O)_2—O)m—CH_3$, average m is 4 | Methanol | 25 | 9.6 | 75 | 0.05 |
| Example 5-3) | $CH_3O—(Si(CH_3O)_2—O)m—CH_3$, average m is 4 | Methanol | 25 | 9.6 | 75 | 0.05 |

| Binding agent | Viscosity (mPa · s) | Flexural strength (MPa) | Specific resistance (Ωcm) | Magnetic characteristics of magnet: Residual magnetic flux density (kG) | Coercivity (kOe) | Irreversible heat demagnetization rate (%) |
|---|---|---|---|---|---|---|
| Example 1-1) | 1.8 | 35 | 0.0017 | 7.1 | 12.2 | <1 |
| Example 1-2) | 17 | 140 | 0.0019 | 6.8 | 12.2 | <1 |
| Example 1-3) | 80 | 210 | 0.0025 | 6.7 | 12.2 | <1 |
| Example 2-1) | 8.7 | 72 | 0.0016 | 6.9 | 12.2 | <1 |
| Example 2-2) | 17 | 140 | 0.0019 | 6.8 | 12.2 | <1 |
| Example 2-3) | 38 | 170 | 0.0031 | 6.7 | 12.2 | <1 |
| Example 3-1) | 3.9 | 110 | 0.0021 | 6.9 | 12.2 | <1 |
| Example 3-2) | 17 | 140 | 0.0019 | 6.9 | 12.2 | <1 |
| Example 3-3) | 56 | 150 | 0.0019 | 6.8 | 12.2 | <1 |
| Example 4-1) | 3.9 | 110 | 0.0021 | 6.9 | 12.2 | <1 |
| Example 4-2) | 2.6 | 94 | 0.0020 | 6.9 | 12.2 | <1 |
| Example 4-3) | 2.1 | 79 | 0.0019 | 7.0 | 12.2 | <1 |
| Example 5-1) | 23 | 130 | 0.0035 | 6.8 | 12.2 | <1 |
| Example 5-2) | 38 | 170 | 0.0031 | 6.7 | 12.2 | <1 |
| Example 5-3) | 92 | 180 | 0.0029 | 6.7 | 12.2 | <1 |

EXAMPLE 2

In this example, magnetic powder crushed from NdFeB-based ribbons as in Example 1 was used as the rare-earth magnetic powder.

The following three solutions were used as the $SiO_2$ precursor, which is binding agent.

1) A mixture of 25 ml of $CH_3O—(Si(CH_3O)_2—O)_m—CH_3$ (m is 3-5, average 4), 0.96 ml of water, 75 ml of dehydrated methanol, and 0.05 ml of dibutyltin dilaurate was prepared and left standing at a temperature of 25° C. for 2 days.

2) A mixture of 25 ml of $CH_3O—(Si(CH_3O)_2—O)_m—CH_3$ (m is 3-5, average 4), 4.8 ml of water, 75 ml of dehydrated methanol, and 0.05 ml of dibutyltin dilaurate was prepared and left standing at a temperature of 25° C. for 2 days.

3) A mixture of 100 ml of $CH_3O—(Si(CH_3O)_2—O)_m—CH_3$ (m is 3-5, average 4), 9.6 ml of water, 75 ml of dehydrated methanol, and 0.05 ml of dibutyltin dilaurate was prepared and left standing at a temperature of 25° C. for 2 days.

The viscosities of the $SiO_2$ precursor solutions described above were measured using an Ostwald viscometer at 30° C.

(1) Compression molded test pieces with 10 mm length, 10 mm width and 5 mm thickness for magnetic characteristic measurement and with 15 mm length, 10 mm width and 2 mm thickness for strength measurement were produced by filling molds with $Nd_2Fe_{14}B$ magnetic powder, described above, and applying pressure at 16 t/cm$^2$.

(2) The compression molded test pieces prepared in (1) were disposed in a vat so that the direction of pressure application was horizontal, and the binding agent, $SiO_2$ precursor solution from 1) through 3) described above were poured into the vat at a rate of liquid surface rising vertically 1 mm/min until reaching to 5 mm above the upper face of the compression molded test pieces.

(3) The vat from (2) containing the compression molded test pieces and filled with the $SiO_2$ precursor solution was set in a vacuum chamber, and the air was exhausted slowly to about 80 Pa. The vat was left standing until few bubbles were generated from the surface of the compression molded test pieces.

(4) Internal pressure of the vacuum chamber, in which the vat containing the compression molded test pieces and filled with the $SiO_2$ precursor solution was set, was slowly returned to atmospheric pressure, and the compression molded test pieces were taken out of the $SiO_2$ precursor solution.

(5) The compression molded test pieces that had been infiltrated with the $SiO_2$ precursor solutions prepared in (4) described above were set in a vacuum drying oven and vacuum heat-treated under the conditions of a pressure of 1-3 Pa and a temperature of 150° C.

(6) The specific resistances of the compression molded test pieces with 10 mm length, 10 mm width and 5 mm thickness that were produced in (5) were measured by the 4 probe method.

(7) Further, a pulse magnetic field of 30 kOe or above was applied to the compression molded test pieces, which were subjected to the specific resistance measurement as described above, and the magnetic characteristic of the compression molded test piece was investigated.

(8) A mechanical bending test was conducted using the compression molded test pieces with 15 mm length, 10 mm width and 2 mm thickness that were produced in (5). Samples of the compression molded pieces with a form of 15 mm×10 mm×2 mm were subjected to bending tests to evaluate flexural strength by 3 points bending tests with 12 mm distance between the points.

Regarding the magnetic characteristics of the compression molded test pieces with 10 mm length, 10 mm width and 5 mm thickness prepared in (5), there could be a 20-30% improvement in residual magnetic flux density compared to a bond magnet containing resin (comparative example 1). Regarding the demagnetization curve measured at 20° C., the residual magnetic flux density and coercivity values were roughly the same for shaped bodies before $SiO_2$ infiltration and after $SiO_2$ infiltration and heating. Also, the heat demagnetization rate after 1 hour in a 200° C. atmosphere was 3.0% for $SiO_2$ infiltrated bond magnets, which was less than the heat demagnetization rate with no $SiO_2$ infiltration (5%). Furthermore, after 1 hour in a 200° C. atmosphere, the irreversible heat demagnetization rate was no more than 1% after $SiO_2$ infiltration and heating, which was less than the value of almost 3% when no $SiO_2$ infiltration was involved. This is due to the $SiO_2$ limiting deterioration of the magnet particles due to oxidation.

The flexural strength of the compression molded test pieces with 15 mm length, 10 mm width and 2 mm thickness prepared in (7) was no more than 2 MPa before infiltration with $SiO_2$, but it became at least 70 MPa after $SiO_2$ infiltration and heating. When the $SiO_2$ precursor solution in 2) and 3) of this example were used, it was possible to manufacture magnetic shaped bodies with flexural strengths of 100 MPa or higher.

Regarding the specific resistance of the magnets, the magnets of the present invention had values that were approximately 10 times those of sintered rare-earth magnets but were approximately 1/10 the value of compression-type rare-earth bond magnets. While there is some increase in eddy current loss, it is not enough to obstruct use.

Based on the results from this example, compared to standard rare-earth bond magnets containing resin, rare-earth bond magnets in which low-viscosity $SiO_2$ precursor of the present invention had been infiltrated into a rare-earth magnet shaped body cold formed without resin according to the present invention showed an improvement of 20-30% magnetic characteristics, bend strengths that were 2 to 3 times as high, a reduction in the irreversible heat demagnetization rate to half or less, and improved reliability of the magnet.

EXAMPLE 3

In this example, magnetic powder crushed from NdFeB-based ribbons as in Example 1 was used as the rare-earth magnetic powder.

The following three solutions were used as the $SiO_2$ precursor, which is binding agent.

1) A mixture of 25 ml of $CH_3O—(Si(CH_3O)_2—O)—CH_3$, 5.9 ml of water, 75 ml of dehydrated methanol, and 0.05 ml of dibutyltin dilaurate was prepared and left standing at a temperature of 25° C. for 2 days.

2) A mixture of 25 ml of $CH_3O—(Si(CH_3O)_2—O)_m—CH_3$ (m is 3-5, average 4), 4.8 ml of water, 75 ml of dehydrated methanol, and 0.05 ml of dibutyltin dilaurate was prepared and left standing at a temperature of 25° C. for 2 days.

3) A mixture of 25 ml of $CH_3O—(Si(CH_3O)_2—O)_m—CH_3$ (m is 6-8, average 7), 4.6 ml of water, 75 ml of dehydrated methanol, and 0.05 ml of dibutyltin dilaurate was prepared and left standing at a temperature of 25° C. for 2 days.

The viscosities of the $SiO_2$ precursor solutions described above were measured using an Ostwald viscometer at 30° C.

(1) Compression molded test pieces with 10 mm length, 10 mm width and 5 mm thickness for magnetic characteristic measurement and with 15 mm length, 10 mm width and 2 mm thickness for strength measurement were produced by filling molds with $Nd_2Fe_{14}B$ magnetic powder, described above, and applying pressure at 16 t/cm$^2$.

(2) The compression molded test pieces prepared in (1) were disposed in a vat so that the direction of pressure application was horizontal, and the binding agent, $SiO_2$ precursor solution from 1) through 3) described above were poured into the vat at a rate of liquid surface rising vertically 1 mm/min until reaching to 5 mm above the upper face of the compression molded test pieces.

(3) The vat from (2) containing the compression molded test pieces and filled with the $SiO_2$ precursor solution was set in a vacuum chamber, and the air was exhausted slowly to about 80 Pa. The vat was left standing until few bubbles were generated from the surface of the compression molded test pieces.

(4) Internal pressure of the vacuum chamber, in which the vat containing the compression molded test pieces and filled with the $SiO_2$ precursor solution was set, was slowly returned to atmospheric pressure, and the compression molded test pieces were taken out of the $SiO_2$ precursor solution.

(5) The compression molded test pieces that had been infiltrated with the $SiO_2$ precursor solutions prepared in (4) described above were set in a vacuum drying oven and vacuum heat-treated under the conditions of a pressure of 1-3 Pa and a temperature of 150° C.

(6) The specific resistances of the compression molded test pieces with 10 mm length, 10 mm width and 5 mm thickness that were produced in (5) were measured by the 4 probe method.

(7) Further, a pulse magnetic field of 30 kOe or above was applied to the compression molded test pieces, which were subjected to the specific resistance measurement as described above, and the magnetic characteristic of the compression molded test piece was investigated.

(8) A mechanical bending test was conducted using the compression molded test pieces with 15 mm length, 10 mm width and 2 mm thickness that were produced in (5). Samples of the compression molded pieces with a form of 15 mm×10 mm×2 mm were subjected to bending tests to evaluate flexural strength by 3 points bending tests with 12 mm distance between the points.

Regarding the magnetic characteristics of the compression molded test pieces with 10 mm length, 10 mm width and 5 mm thickness prepared in (5), there could be a 20-30% improvement in residual magnetic flux density compared to a bond magnet containing resin (comparative example 1). Regarding the demagnetization curve measured at 20° C., the residual magnetic flux density and coercivity values were roughly the same for shaped bodies before $SiO_2$ infiltration and after $SiO_2$ infiltration and heating. Also, the heat demagnetization rate after 1 hour in a 200° C. atmosphere was 3.0% for $SiO_2$ infiltrated bond magnets, which was less than the heat demagnetization rate with no $SiO_2$ infiltration (5%). Furthermore, after 1 hour in a 200° C. atmosphere, the irreversible heat demagnetization rate was no more than 1% after $SiO_2$ infiltration and heating, which was less than the value of almost 3% when no $SiO_2$ infiltration was involved. This is due to the $SiO_2$ limiting deterioration of the magnet particles due to oxidation.

The flexural strength of the compression molded test pieces with 15 mm length, 10 mm width and 2 mm thickness prepared in (7) was no more than 2 MPa before infiltration with $SiO_2$, but it became possible to manufacture magnetic shaped bodies with flexural strengths of 100 MPa or higher after $SiO_2$ infiltration and heating.

Regarding the specific resistance of the magnets, the magnets of the present invention had values that were approximately 10 times those of sintered rare-earth magnets but were approximately 1/10 the value of compression-type rare-earth bond magnets. However, this reduction in specific resistance is not a major problem. For example, in the case of use in a motor, the eddy current loss increases somewhat but not enough to pose a problem in practice.

Based on the results from this example, compared to standard rare-earth bond magnets containing resin, rare-earth bond magnets in which low-viscosity $SiO_2$ precursor of the present invention had been infiltrated into a rare-earth magnet shaped body cold formed without resin according to the present invention showed an improvement of 20-30% magnetic characteristics, bend strengths that were 2 to 3 times as high, a reduction in the irreversible heat demagnetization rate to half or less, and improved reliability of the magnet.

EXAMPLE 4

In this example, magnetic powder crushed from NdFeB-based ribbons as in Example 1 was used as the rare-earth magnetic powder.

The following three solutions were used as the $SiO_2$ precursor, which is binding agent.

1) A mixture of 25 ml of $CH_3O—(Si(CH_3O)_2—O)—CH_3$, 5.9 ml of water, 75 ml of dehydrated methanol, and 0.05 ml of dibutyltin dilaurate was prepared and left standing at a temperature of 25° C. for 2 days.

2) A mixture of 25 ml of $C_2H_5O—(Si(C_2H_5O)_2—O)—CH_3$, 4.3 ml of water, 75 ml of dehydrated methanol, and 0.05 ml of dibutyltin dilaurate was prepared and left standing at a temperature of 25° C. for 3 days.

3) A mixture of 25 ml of $n\text{-}C_3H_7O—(Si(C_2H_5O)_2—O)\text{-}n\text{-}C_3H_7$, 3.4 ml of water, 75 ml of dehydrated isopropanol, and 0.05 ml of dibutyltin dilaurate was prepared and left standing at a temperature of 25° C. for 6 days.

The viscosities of the $SiO_2$ precursor solutions described above were measured using an Ostwald viscometer at 30° C.

(1) Compression molded test pieces with 10 mm length, 10 mm width and 5 mm thickness for magnetic characteristic measurement and with 15 mm length, 10 mm width and 2 mm thickness for strength measurement were produced by filling molds with $Nd_2Fe_{14}B$ magnetic powder, described above, and applying pressure at 16 t/cm$^2$.

(2) The compression molded test pieces prepared in (1) were disposed in a vat so that the direction of pressure application was horizontal, and the binding agent, $SiO_2$ precursor solution from 1) through 3) described above were poured into the vat at a rate of liquid surface rising vertically 1 mm/min until reaching to 5 mm above the upper face of the compression molded test pieces.

(3) The vat from (2) containing the compression molded test pieces and filled with the $SiO_2$ precursor solution was set in a vacuum chamber, and the air was exhausted slowly to about 80 Pa. The vat was left standing until few bubbles were generated from the surface of the compression molded test pieces.

(4) Internal pressure of the vacuum chamber, in which the vat containing the compression molded test pieces and filled with the $SiO_2$ precursor solution was set, was slowly returned to atmospheric pressure, and the compression molded test pieces were taken out of the $SiO_2$ precursor solution.

(5) The compression molded test pieces that had been infiltrated with the $SiO_2$ precursor solutions prepared in (4) described above were set in a vacuum drying oven and vacuum heat-treated under the conditions of a pressure of 1-3 Pa and a temperature of 150° C.

(6) The specific resistances of the compression molded test pieces with 10 mm length, 10 mm width and 5 mm thickness that were produced in (5) were measured by the 4 probe method.

(7) Further, a pulse magnetic field of 30 kOe or above was applied to the compression molded test pieces, which were subjected to the specific resistance measurement as described above, and the magnetic characteristic of the compression molded test piece was investigated.

(8) A mechanical bending test was conducted using the compression molded test pieces with 15 mm length, 10 mm width and 2 mm thickness that were produced in (5). Samples of the compression molded pieces with a form of 15 mm×10 mm×2 mm were subjected to bending tests to evaluate flexural strength by 3 points bending tests with 12 mm distance between the points.

Regarding the magnetic characteristics of the compression molded test pieces with 10 mm length, 10 mm width and 5 mm thickness prepared in (5), there could be a 20-30% improvement in residual magnetic flux density compared to a bond magnet containing resin (comparative example 1). Regarding the demagnetization curve measured at 20° C., the residual magnetic flux density and coercivity values were roughly the same for shaped bodies before $SiO_2$ infiltration and after $SiO_2$ infiltration and heating. Also, the heat demagnetization rate after 1 hour in a 200° C. atmosphere was 3.0% for $SiO_2$ infiltrated bond magnets, which was less than the heat demagnetization rate with no $SiO_2$ infiltration (5%). Furthermore, after 1 hour in a 200° C. atmosphere, the irreversible heat demagnetization rate was no more than 1% after $SiO_2$ infiltration and heating, which was less than the value of almost 3% when no $SiO_2$ infiltration was involved. This is due to the $SiO_2$ limiting deterioration of the magnet particles due to oxidation.

The flexural strength of the compression molded test pieces with 15 mm length, 10 mm width and 2 mm thickness prepared in (7) was no more than 2 MPa before infiltration with $SiO_2$, but it became possible to manufacture magnetic shaped bodies with flexural strengths of 80 MPa or higher after $SiO_2$ infiltration and heating.

Regarding the specific resistance of the magnets, the magnets of the present invention had values that were approximately 10 times those of sintered rare-earth magnets but were approximately 1/10 the value of compression-type rare-earth bond magnets. While there is an increase somewhat in eddy current loss, this degree of reduction in specific resistance is not enough to pose a problem.

Based on the results from this example, compared to standard rare-earth bond magnets containing resin, rare-earth bond magnets in which low-viscosity $SiO_2$ precursor of the present invention had been infiltrated into a rare-earth magnet shaped body cold formed without resin according to the present invention showed an improvement of 20-30% magnetic characteristics, bend strengths that were approximately 2 times as high, a reduction in the irreversible heat demagnetization rate to half or less, and improved reliability of the magnet.

EXAMPLE 5

In this example, magnetic powder crushed from NdFeB-based ribbons as in Example 1 was used as the rare-earth magnetic powder.

The following three solutions were used as the $SiO_2$ precursor, which is binding agent.

1) A mixture of 25 ml of $CH_3O$— (Si $(CH_3O)_2$—O)$_m$—$CH_3$ (m is 3-5, average 4), 9.6 ml of water, 75 ml of dehydrated methanol, and 0.05 ml of dibutyltin dilaurate was prepared and left standing at a temperature of 25° C. for 1 day.

2) A mixture of 25 ml of $CH_3O$—(Si$(CH_3O)_2$—O)$_m$—$CH_3$ (m is 3-5, average 4), 9.6 ml of water, 75 ml of dehydrated methanol, and 0.05 ml of dibutyltin dilaurate was prepared and left standing at a temperature of 25° C. for 2 days.

3) A mixture of 100 ml of $CH_3O$—(Si$(CH_3O)_2$—O)$_m$—$CH_3$ (m is 3-5, average 4), 9.6 ml of water, 75 ml of dehydrated methanol, and 0.05 ml of dibutyltin dilaurate was prepared and left standing at a temperature of 25° C. for 4 days.

The viscosities of the $SiO_2$ precursor solutions described above were measured using an Ostwald viscometer at 30° C.

(1) Compression molded test pieces with 10 mm length, 10 mm width and 5 mm thickness for magnetic characteristic measurement and with 15 mm length, 10 mm width and 2 mm thickness for strength measurement were produced by filling molds with $Nd_2Fe_{14}B$ magnetic powder, described above, and applying pressure at 16 t/cm$^2$.

(2) The compression molded test pieces prepared in (1) were disposed in a vat so that the direction of pressure application was horizontal, and the binding agent, $SiO_2$ precursor solution from 1) through 3) described above were poured into the vat at a rate of liquid surface rising vertically 1 mm/min until reaching to 5 mm above the upper face of the compression molded test pieces.

(3) The vat from (2) containing the compression molded test pieces and filled with the $SiO_2$ precursor solution was set in a vacuum chamber, and the air was exhausted slowly to about 80 Pa. The vat was left standing until few bubbles were generated from the surface of the compression molded test pieces.

(4) Internal pressure of the vacuum chamber, in which the vat containing the compression molded test pieces and filled with the $SiO_2$ precursor solution was set, was slowly returned to atmospheric pressure, and the compression molded test pieces were taken out of the $SiO_2$ precursor solution.

(5) The compression molded test pieces that had been infiltrated with the $SiO_2$ precursor solutions prepared in (4) described above were set in a vacuum drying oven and vacuum heat-treated under the conditions of a pressure of 1-3 Pa and a temperature of 150° C.

(6) The specific resistances of the compression molded test pieces with 10 mm length, 10 mm width and 5 mm thickness that were produced in (5) were measured by the 4 probe method.

(7) Further, a pulse magnetic field of 30 kOe or above was applied to the compression molded test pieces, which were subjected to the specific resistance measurement as described above, and the magnetic characteristic of the compression molded test piece was investigated.

(8) A mechanical bending test was conducted using the compression molded test pieces with 15 mm length, 10 mm width and 2 mm thickness that were produced in (5). Samples of the compression molded pieces with a form of 15 mm×10 mm×2 mm were subjected to bending tests to evaluate flexural strength by 3 points bending tests with 12 mm distance between the points.

Regarding the magnetic characteristics of the compression molded test pieces with 10 mm length, 10 mm width and 5 mm thickness prepared in (5) described above, there could be a 20-30% improvement in residual magnetic flux density compared to a bond magnet containing resin (comparative example 1). Regarding the demagnetization curve measured at 20° C., the residual magnetic flux density and coercivity values were roughly the same for shaped bodies before $SiO_2$ infiltration and after $SiO_2$ infiltration and heating. Also, the heat demagnetization rate after 1 hour in a 200° C. atmosphere was 3.0% for $SiO_2$ infiltrated bond magnets, which was less than the heat demagnetization rate with no $SiO_2$ infiltration (5%). Furthermore, after 1 hour in a 200° C. atmosphere, the irreversible heat demagnetization rate was no more than 1% after $SiO_2$ infiltration and heating, which was less than the value of almost 3% when no $SiO_2$ infiltration was involved. This is due to the $SiO_2$ limiting deterioration of the magnet particles due to oxidation.

The flexural strength of the compression molded test pieces with 15 mm length, 10 mm width and 2 mm thickness prepared in (7) described above was no more than 2 MPa before infiltration with $SiO_2$, but it became possible to manufacture magnetic shaped bodies with flexural strengths of 130 MPa or higher after $SiO_2$ infiltration and heating.

Regarding the specific resistance of the magnets, the magnets of the present invention had values that were approximately 10 times those of sintered rare-earth magnets but were approximately 1/10 the value of compression-type rare-earth bond magnets. While there is an increase somewhat in eddy current loss, this degree of reduction in specific resistance is not enough to pose a problem.

Based on the results from this example, compared to standard rare-earth bond magnets containing resin, rare-earth bond magnets in which low-viscosity $SiO_2$ precursor of the present invention had been infiltrated into a rare-earth magnet shaped body cold formed without resin according to the present invention showed an improvement of 20-30% magnetic characteristics, bend strengths that were 3-4 times as high, a reduction in the irreversible heat demagnetization rate to half or less, and improved reliability of the magnet.

EXAMPLE 6

In this example, magnetic powder crushed from NdFeB-based ribbons as in Example 1 was used as the rare-earth magnetic powder.

A solution for forming a rare-earth fluoride or an alkali-earth metal fluoride coat film was prepared in the following manner.

(1) A salt with high water-solubility is placed in water, e.g., in the case of La, 4 g of acetic acid La or nitric acid La in 100 mL water, and completely dissolved with a shaker or an ultrasonic mixer.

(2) Hydrofluoric acid diluted to 10% was slowly added up to an equivalent amount of the chemical reaction generating $LaF_3$.

(3) The solution, in which gel-like precipitates of $LaF_3$ were formed, was stirred using an ultrasonic mixer for 1 hour or longer.

(4) After centrifuging at 4000-6000 rpm, the supernatant was removed, and approximately the same volume of methanol was added.

(5) After stirring the methanol solution containing gel-like $LaF_3$ to prepare homogeneous suspension, the suspension was further stirred for 1 hour or longer using an ultrasonic mixer.

(6) The operations of (4) and (5) described above were repeated 3-10 times until negative ions, e.g., acetate ions or nitrate ions, were no longer detected.

(7) Finally, in the case of $LaF_3$, almost transparent sol-like $LaF_3$ was obtained. For the treatment solution, $LaF_3$ was dissolved in methanol at 1 g/5 mL.

Table 3 summarizes other rare-earth fluoride and alkali-earth metal fluoride coat film solutions that were used.

(3) The magnetic powder for rare-earth magnet that underwent solvent removal as described in (2) was transferred to a quartz boat, and heated at 200° C. for 30 min and at 400° C. for 30 min under reduced pressure of $1\times10^{-5}$ torr.

(4) The magnetic powder that underwent heat treatment as described in (3) was transferred to a container with a lid made of Macor (Riken Denshi Co., Ltd.) and then heated at 700° C. for 30 min under reduced pressure of $1\times10^{-5}$ torr.

For the $SiO_2$ precursor, which is binding agent, 25 ml of $CH_3O—(Si(CH_3O)_2—O)_m—CH_3$ (m is 3-5, average 4), 4.8 ml of water, 75 ml of dehydrated methanol, and 0.05 ml of dibutyltin dilaurate were mixed and left standing at a temperature of 25° C. for 2 days.

(1) The magnetic powder of $Nd_2Fe_{14}B$ that was coated with the rare-earth fluoride or alkali-earth metal fluoride coat film was placed in molds, and a test piece for measuring the magnetic characteristic with a dimension of 10 mm length, 10 mm width and 5 mm thickness and a compression molded test piece for measuring the strength with a dimension of 15 mm length, 10 mm width and 2 mm thickness were produced under the pressure of 16 t/cm$^2$.

TABLE 3

Characteristics of powder magnet from magnetic powder formed with rare-earth fluoride, alkali earth-metal fluoride coat film

| Processing solution | Component | Amount of processing solution added per 100 g magnetic powder | Concentration | Solvent | Flexural strength (MPa) | Specific resistance (Ωcm) | Residual magnetic flux density (kG) | Corecivity (kOe) | Irreversible heat demagnetization rate |
|---|---|---|---|---|---|---|---|---|---|
| Example 6-1) | $MgF_2$ | 15 mL | 100 g/dm3 | Methanol | 130 | 0.032 | 6.6 | 12.2 | <1 |
| Example 6-2) | $CaF_2$ | 15 mL | 100 g/dm3 | Methanol | 100 | 0.026 | 6.5 | 12.2 | <1 |
| Example 6-3) | $LaF_3$ | 15 mL | 100 g/dm3 | Methanol | 120 | 0.03 | 6.5 | 12.3 | <1 |
| Example 6-4) | $LaF_3$ | 15 mL | 100 g/dm3 | Ethanol | 97 | 0.027 | 6.4 | 12.5 | <1 |
| Example 6-5) | $LaF_3$ | 15 mL | 100 g/dm3 | n-propanol | 76 | 0.025 | 6.5 | 12.3 | <1 |
| Example 6-6) | $LaF_3$ | 15 mL | 100 g/dm3 | Iso-propanol | 54 | 0.021 | 6.6 | 12.3 | <1 |
| Example 6-7) | $CeF_3$ | 15 mL | 100 g/dm3 | Methanol | 110 | 0.029 | 6.5 | 12.3 | <1 |
| Example 6-8) | $PrF_3$ | 15 mL | 100 g/dm3 | Methanol | 110 | 0.031 | 6.4 | 13.8 | <1 |
| Example 6-9) | $NdF_3$ | 15 mL | 100 g/dm3 | Methanol | 110 | 0.028 | 6.6 | 12.5 | <1 |
| Example 6-10) | $SmF_3$ | 15 mL | 100 g/dm3 | Methanol | 75 | 0.023 | 6.6 | 12.5 | <1 |
| Example 6-11) | $EuF_3$ | 15 mL | 100 g/dm3 | Methanol | 73 | 0.022 | 6.5 | 12.4 | <1 |
| Example 6-12) | $GdF_3$ | 15 mL | 100 g/dm3 | Methanol | 69 | 0.023 | 6.4 | 12.3 | <1 |
| Example 6-13 | $TbF_3$ | 15 mL | 100 g/dm3 | Methanol | 70 | 0.025 | 6.4 | 18.9 | <1 |
| Example 6-14) | $DyF_3$ | 15 mL | 100 g/dm3 | Methanol | 68 | 0.026 | 6.3 | 18.5 | <1 |
| Example 6-15) | $HoF_3$ | 15 mL | 100 g/dm3 | Methanol | 57 | 0.024 | 6.4 | 12.6 | <1 |
| Example 6-16) | $ErF_3$ | 15 mL | 100 g/dm3 | Methanol | 52 | 0.021 | 6.5 | 12.5 | <1 |
| Example 6-17) | $TmF_3$ | 15 mL | 100 g/dm3 | Methanol | 56 | 0.023 | 6.5 | 12.9 | <1 |
| Example 6-18) | $YbF_3$ | 15 mL | 100 g/dm3 | Methanol | 53 | 0.025 | 6.4 | 12.2 | <1 |
| Example 6-19) | $LuF_3$ | 15 mL | 100 g/dm3 | Methanol | 50 | 0.027 | 6.1 | 12.3 | <1 |
| Example 7-1) | $PrF_3$ | 1 mL | 10 g/dm3 | Methanol | 130 | 0.018 | 6.3 | 13.1 | <1 |
| Example 7-2) | $PrF_3$ | 10 mL | 10 g/dm3 | Methanol | 120 | 0.018 | 6.5 | 13.5 | <1 |
| Example 7-3) | $PrF_3$ | 30 mL | 10 g/dm3 | Methanol | 120 | 0.018 | 6.4 | 13.6 | <1 |
| Example 8-1) | $DyF_3$ | 10 mL | 1 g/dm3 | Methanol | 130 | 0.018 | 6.5 | 13.5 | <1 |
| Example 8-2) | $DyF_3$ | 10 mL | 10 g/dm3 | Methanol | 110 | 0.017 | 6.6 | 15.5 | <1 |
| Example 8-3) | $DyF_3$ | 10 mL | 200 g/dm3 | Methanol | 42 | 0.036 | 6.5 | 18.5 | <1 |

Rare-earth fluoride or alkali-earth metal fluoride coat film was formed on the $Nd_2Fe_{14}B$ magnetic powder using the following process.

The case of $NdF_3$ coat film forming process: $NdF_3$ concentration 1 g/10 mL, semi-transparent sol-like solution. (1) Fifteen mL of $NdF_3$ coat film forming solution was added to 100 g of the magnetic powder prepared by crushing an NdFeB-based ribbon and mixed until wetness of all the magnetic powder for rare-earth magnet was confirmed.

(2) Solvent methanol was removed from the magnetic powder for rare-earth magnet, which underwent the $NdF_3$ coat film forming treatment as described in (1), under reduced pressure of 2-5 torr.

(2) The compression molded test pieces prepared in (1) described above were disposed in a vat so that the direction of pressure application was horizontal, and the binding agent, $SiO_2$ precursor solution left standing for 2 days at a temperature of 25° C. was poured into the vat at a rate of liquid surface rising vertically 1 mm/min until reaching to 5 mm above the upper face of the compression molded test pieces.

(3) The vat from (2) containing the compression molded test pieces and filled with the $SiO_2$ precursor solution was set in a vacuum chamber, and the air was exhausted slowly to about 80 Pa. The vat was left standing until few bubbles were generated from the surface of the compression molded test pieces.

(4) Internal pressure of the vacuum chamber, in which the vat containing the compression molded test pieces and filled with the $SiO_2$ precursor solution was set, was slowly returned to atmospheric pressure, and the compression molded test pieces were taken out of the $SiO_2$ precursor solution.

(5) The compression molded test pieces that had been infiltrated with the $SiO_2$ precursor solutions prepared in (4) described above were set in a vacuum drying oven and vacuum heat-treated under the conditions of a pressure of 1-3 Pa and a temperature of 150° C.

(6) The specific resistances of the compression molded test pieces with 10 mm length, 10 mm width and 5 mm thickness that were produced in (5) described above were measured by the 4 probe method.

(7) Further, a pulse magnetic field of 30 kOe or above was applied to the compression molded test pieces, which were subjected to the specific resistance measurement as described above, and the magnetic characteristic of the compression molded test piece was investigated.

(8) A mechanical bending test was conducted using the compression molded test pieces with 15 mm length, 10 mm width and 2 mm thickness that were produced in (5) described above. Samples of the compression molded pieces with a form of 15 mm×10 mm×2 mm were subjected to bending tests to evaluate flexural strength by 3 points bending tests with 12 mm distance between the points.

Regarding the magnetic characteristics of the compression molded test pieces with 10 mm length, 10 mm width and 5 mm thickness prepared in (5) described above, there could be a 20-30% improvement in residual magnetic flux density compared to a bond magnet containing resin (comparative example 1). Regarding the demagnetization curve measured at 20° C., the residual magnetic flux density and coercivity values were roughly the same for shaped bodies before $SiO_2$ infiltration and after $SiO_2$ infiltration and heating. Also, the heat demagnetization rate after 1 hour in a 200° C. atmosphere was 3.0% for $SiO_2$ infiltrated bond magnets, which was less than the heat demagnetization rate with no $SiO_2$ infiltration (5%). Furthermore, after 1 hour in a 200° C. atmosphere, the irreversible heat demagnetization rate was no more than 1% after $SiO_2$ infiltration and heating, which was less than the value of almost 3% when no $SiO_2$ infiltration was involved. This is due to the $SiO_2$ limiting deterioration of the magnet particles due to oxidation.

In addition to the advantages described later of the presence of an insulating film, with the magnet of this example, in which a rare-earth fluoride or alkali-earth metal fluoride coat film was formed on rare-earth magnetic powder, it was found that the coercivity of magnets could be improved by the use in the coat film of $TbF_3$ and $DyF_3$, and to a lesser extent of $PrF_3$.

The flexural strength of the compression molded test pieces with 15 mm length, 10 mm width and 2 mm thickness prepared in (7) described above was no more than 2 MPa before infiltration with $SiO_2$, but it became possible to manufacture magnetic shaped bodies with flexural strengths of 50 MPa or higher and heating.

Regarding the specific resistance of the magnets, the magnets of the present invention had values that were approximately 100 times or more those of sintered rare-earth magnets and were approximately the same value as compression-type rare-earth bond magnets. Thus, the magnet has low eddy current loss and good characteristics.

Based on the results from this example, compared to standard rare-earth bond magnets containing resin, rare-earth bond magnets in which low-viscosity $SiO_2$ precursor of the present invention had been infiltrated into a rare-earth magnet shaped body cold formed without resin according to the present invention showed an improvement of approximately 20% in magnetic characteristics, bend strengths that were 1-3 times as high, a reduction in the irreversible heat demagnetization rate to half or less, and improved reliability of the magnet. In addition, there was a significant improvement in magnetic characteristics when $TbF_3$ and $DyF_3$ were used in forming the coat film.

EXAMPLE 7

In this example, magnetic powder crushed from NdFeB-based ribbons as in Example 1 was used.

A rare-earth fluoride or an alkali-earth metal fluoride coat film was formed on the $Nd_2Fe_{14}B$ magnetic powder according to the following process.

The case of $PrF_3$ coat film forming process: $PrF_3$ concentration 0.1 g/10 mL, semi-transparent sol-like solution was used.

(1) One to 30 mL of $PrF_3$ coat film forming solution was added to 100 g of the magnetic powder prepared by crushing an NdFeB-based ribbon and mixed until wetness of all the magnetic powder for rare-earth magnet was confirmed.

(2) Solvent methanol was removed from the magnetic powder for rare-earth magnet, which underwent the $PrF_3$ coat film forming treatment as described in (1), under reduced pressure of 2-5 torr.

(3) The magnetic powder for rare-earth magnet that underwent solvent removal as described in (2) was transferred to a quartz boat, and heated at 200° C. for 30 min and at 400° C. for 30 min under reduced pressure of $1\times10^{-5}$ torr.

(4) The magnetic powder that underwent heat treatment as described in (3) was transferred to a container with a lid made of Macor (Riken Denshi Co., Ltd.) and then heated at 700° C. for 30 min under reduced pressure of $1\times10^{-5}$ torr.

For the $SiO_2$ precursor, which is binding agent, 25 ml of $CH_3O—(Si(CH_3O)_2—O)_m—CH_3$ (m is 3-5, average 4), 4.8 ml of water, 75 ml of dehydrated methanol, and 0.05 ml of dibutyltin dilaurate were mixed and left standing at a temperature of 25° C. for 2 days.

(1) The magnetic powder of $Nd_2Fe_{14}B$ that was coated with the $PrF_3$ coat film was placed in molds, and a test piece for measuring the magnetic characteristic with a dimension of 10 mm length, 10 mm width and 5 mm thickness and a compression molded test piece for measuring the strength with a dimension of 15 mm length, 10 mm width and 2 mm thickness were produced under the pressure of 16 t/cm$^2$.

(2) The compression molded test pieces prepared in (1) described above were disposed in a vat so that the direction of pressure application was horizontal, and the binding agent, $SiO_2$ precursor solution left standing for 2 days at a temperature of 25° C. was poured into the vat at a rate of liquid surface rising vertically 1 mm/min until reaching to 5 mm above the upper face of the compression molded test pieces.

(3) The vat from (2) containing the compression molded test pieces and filled with the $SiO_2$ precursor solution was set in a vacuum chamber, and the air was exhausted slowly to about 80 Pa. The vat was left standing until few bubbles were generated from the surface of the compression molded test pieces.

(4) Internal pressure of the vacuum chamber, in which the vat containing the compression molded test pieces and filled with the $SiO_2$ precursor solution was set, was slowly returned to atmospheric pressure, and the compression molded test pieces were taken out of the $SiO_2$ precursor solution.

(5) The compression molded test pieces that had been infiltrated with the $SiO_2$ precursor solutions prepared in (4) described above were set in a vacuum drying oven and vacuum heat-treated under the conditions of a pressure of 1-3 Pa and a temperature of 150° C.

(6) The specific resistances of the compression molded test pieces with 10 mm length, 10 mm width and 5 mm thickness that were produced in (5) described above were measured by the 4 probe method.

(7) Further, a pulse magnetic field of 30 kOe or above was applied to the compression molded test pieces, which were subjected to the specific resistance measurement as described above, and the magnetic characteristic of the compression molded test piece was investigated.

(8) A mechanical bending test was conducted using the compression molded test pieces with 15 mm length, 10 mm width and 2 mm thickness that were produced in (5) described above. Samples of the compression molded pieces with a form of 15 mm×10 mm×2 mm were subjected to bending tests to evaluate flexural strength by 3 points bending tests with 12 mm distance between the points.

Regarding the magnetic characteristics of the compression molded test pieces with 10 mm length, 10 mm width and 5 mm thickness prepared in (5), there could be a 20-30% improvement in residual magnetic flux density compared to a bond magnet containing resin (comparative example 1). Regarding the demagnetization curve measured at 20° C., the residual magnetic flux density and coercivity values were roughly the same for shaped bodies before $SiO_2$ infiltration and after $SiO_2$ infiltration and heating. Also, the heat demagnetization rate after 1 hour in a 200° C. atmosphere was 3.0% for $SiO_2$ infiltrated bond magnets, which was less than the heat demagnetization rate with no $SiO_2$ infiltration (5%). Furthermore, after 1 hour in a 200° C. atmosphere, the irreversible heat demagnetization rate was no more than 1% after $SiO_2$ infiltration and heating, which was less than the value of almost 3% when no $SiO_2$ infiltration was involved. This is due to the $SiO_2$ limiting deterioration of the magnet particles due to oxidation.

In addition to the advantages described later of the presence of an insulating film, with the magnet of this example, in which a $PrF_3$ coat film is formed on rare-earth magnetic powder, it was found that while the effect was small, the coercivity of the magnet could be improved.

The flexural strength of the compression molded test pieces with 15 mm length, 10 mm width and 2 mm thickness prepared in (7) described was no more than 2 MPa before infiltration with $SiO_2$, but it became possible to manufacture magnetic shaped bodies with flexural strengths of 100 MPa or higher after $SiO_2$ infiltration and heating.

Regarding the specific resistance of the magnets, the magnets of the present invention had values that were approximately 100 times or more those of sintered rare-earth magnets and were approximately the same value as compression-type rare-earth bond magnets. Thus, the magnet has low eddy current loss and good characteristics.

Based on the results from this example, compared to standard rare-earth bond magnets containing resin, rare-earth bond magnets in which low-viscosity $SiO_2$ precursor of the present invention had been infiltrated into a rare-earth magnet shaped body cold formed without resin according to the present invention showed an improvement of approximately 20% in magnetic characteristics, bend strengths that were 2-3 times as high, a reduction in the irreversible heat demagnetization rate to half or less, and improved reliability of the magnet. In addition, there was an improvement in magnetic characteristics when $PrF_3$ was used in forming the coat film. It was found that magnets using rare-earth magnetic powder formed with a $PrF_3$ coat film provided a well-balanced magnet with overall improvements in magnetic characteristics, bend strength, and reliability.

EXAMPLE 8

In this example, magnetic powder crushed from NdFeB-based ribbons as in Example 1 was used.

A rare-earth fluoride or an alkali-earth metal fluoride coat film was formed on the $Nd_2Fe_{14}B$ magnetic powder according to the following process.

The case of $DyF_3$ coat film forming process: $DyF_3$ concentration 2-0.01 g/10 mL, semi-transparent sol-like solution was used.

(1) Ten mL of $DyF_3$ coat film forming solution was added to 100 g of the magnetic powder prepared by crushing an NdFeB-based ribbon and mixed until wetness of all the magnetic powder for rare-earth magnet was confirmed.

(2) Solvent methanol was removed from the magnetic powder for rare-earth magnet, which underwent the $DyF_3$ coat film forming treatment as described in (1), under reduced pressure of 2-5 torr.

(3) The magnetic powder for rare-earth magnet that underwent solvent removal as described in (2) was transferred to a quartz boat, and heated at 200° C. for 30 min and at 400° C. for 30 min under reduced pressure of $1\times10^{-5}$ torr.

(4) The magnetic powder that underwent heat treatment as described in (3) was transferred to a container with a lid made of Macor (Riken Denshi Co., Ltd.) and then heated at 700° C. for 30 min under reduced pressure of $1\times10^{-5}$ torr.

For the $SiO_2$ precursor, which is binding agent, 25 ml of $CH_3O—(Si(CH_3O)_2—O)_m—CH_3$ (m is 3-5, average 4), 4.8 ml of water, 75 ml of dehydrated methanol, and 0.05 ml of dibutyltin dilaurate were mixed and left standing at a temperature of 25° C. for 2 days.

(1) The magnetic powder of $Nd_2Fe_{14}B$ that was coated with the $DyF_3$ coat film was placed in molds, and a test piece for measuring the magnetic characteristic with a dimension of 10 mm length, 10 mm width and 5 mm thickness and a compression molded test piece for measuring the strength with a dimension of 15 mm length, 10 mm width and 2 mm thickness were produced under the pressure of 16 t/cm$^2$.

(2) The compression molded test pieces prepared in (1) described above were disposed in a vat so that the direction of pressure application was horizontal, and the binding agent, $SiO_2$ precursor solution left standing for 2 days at a temperature of 25° C. was poured into the vat at a rate of liquid surface rising vertically 1 mm/min until reaching to 5 mm above the upper face of the compression molded test pieces.

(3) The vat from (2) containing the compression molded test pieces and filled with the $SiO_2$ precursor solution was set in a vacuum chamber, and the air was exhausted slowly to about 80 Pa. The vat was left standing until few bubbles were generated from the surface of the compression molded test pieces.

(4) Internal pressure of the vacuum chamber, in which the vat containing the compression molded test pieces and filled with the $SiO_2$ precursor solution was set, was slowly returned to atmospheric pressure, and the compression molded test pieces were taken out of the $SiO_2$ precursor solution.

(5) The compression molded test pieces that had been infiltrated with the $SiO_2$ precursor solutions prepared in (4) described above were set in a vacuum drying oven and vacuum heat-treated under the conditions of a pressure of 1-3 Pa and a temperature of 150° C.

(6) The specific resistances of the compression molded test pieces with 10 mm length, 10 mm width and 5 mm thickness that were produced in (5) described above were measured by the 4 probe method.

(7) Further, a pulse magnetic field of 30 kOe or above was applied to the compression molded test pieces, which were subjected to the specific resistance measurement as described above, and the magnetic characteristic of the compression molded test piece was investigated.

(8) A mechanical bending test was conducted using the compression molded test pieces with 15 mm length, 10 mm width and 2 mm thickness that were produced in (5) described above. Samples of the compression molded pieces with a form of 15 mm×10 mm×2 mm were subjected to bending tests to evaluate flexural strength by 3 points bending tests with 12 mm distance between the points.

Regarding the magnetic-characteristics of the compression molded test pieces with 10 mm length, 10 mm width and 5 mm thickness prepared in (5) described above, there could be a 20-30% improvement in residual magnetic flux density compared to a bond magnet containing resin (comparative example 1). Regarding the demagnetization curve measured at 20° C., the residual magnetic flux density and coercivity values were roughly the same for shaped bodies before $SiO_2$ infiltration and after $SiO_2$ infiltration and heating. Also, the heat demagnetization rate after 1 hour in a 200° C. atmosphere was 3.0% for $SiO_2$ infiltrated bond magnets, which was less than the heat demagnetization rate with no $SiO_2$ infiltration (5%). Furthermore, after 1 hour in a 200° C. atmosphere, the irreversible heat demagnetization rate was no more than 1% after $SiO_2$ infiltration and heating, which was less than the value of almost 3% when no $SiO_2$ infiltration was involved. This is due to the $SiO_2$ limiting deterioration of the magnet particles due to oxidation.

In addition to the advantages described later of the presence of an insulating film, with the magnet of this example, in which a $DyF_3$ coat film is formed on rare-earth magnetic powder, it was found that the coercivity of the magnet was improved.

The flexural strength of the compression molded test pieces with 15 mm length, 10 mm width and 2 mm thickness prepared in (7) described above was no more than 2 MPa before infiltration with $SiO_2$, but it became possible to manufacture magnetic shaped bodies with flexural strengths of 40 MPa or higher after $SiO_2$ infiltration and heating.

Regarding the specific resistance of the magnets, the magnets of the present invention had values that were approximately 100 times or more those of sintered rare-earth magnets and were approximately the same value as compression-type rare-earth bond magnets. Thus, the magnet has low eddy current loss and good characteristics.

Based on the results from this example, compared to standard rare-earth bond magnets containing resin, rare-earth bond magnets in which low-viscosity $SiO_2$ precursor of the present invention had been infiltrated into a rare-earth magnet shaped body cold formed without resin according to the present invention showed an improvement of approximately 20% in magnetic characteristics, bend strengths that were 1-3 times as high, a reduction in the irreversible heat demagnetization rate to half or less, and improved reliability of the magnet. In addition, there was a significant improvement in magnetic characteristics when $TbF_3$ and $DyF_3$ were used in forming the coat film.

EXAMPLE 9

In this example, magnetic powder crushed from NdFeB-based ribbons as in Example 1 was used as the rare-earth magnetic powder.

A solution for forming a phosphatized film was prepared as follows.

Twenty g of phosphoric acid, 4 g of boric acid and 4 g of MgO, ZnO, CdO, CaO, or BaO as a metal oxide were dissolved in 1 L of water and a surfactant, EF-104 (Tohkem Products Co., Ltd.), EF-122 (Tohkem Products Co., Ltd.), EF-132 (Tohkem Products Co., Ltd.) was added to achieve concentration of 0.1 wt %. As an antirust agent, benzotriazole (BT), imidazole (IZ), benzoimidazole (BI), thiourea (TU), 2-mercaptobenzoimidazole (MI), octylamine (OA), triethanolamine (TA), o-toluidine (TL), indole (ID), 2-methylpyrrole (MP) were added to achieve 0.04 mol/L.

The following method was used to carry out the process for forming the phosphatized film on the magnetic powder of $Nd_2Fe_{14}B$. The compositions of the phosphatized solution that were used are shown in Table 4.

TABLE 4

Characteristics of powder magnet from magnetic powder formed with phosphotized film

| Processing solution | Metallic oxide component | Surfactant | Antirust agent | Antirust agent concentration (mol/dm3) | Surfactant concentration (wt %) | Processing solution added per 100 g magnetic powder | Flexural strength (MPa) |
|---|---|---|---|---|---|---|---|
| Example 9-1) | MgO | EF-104 | BT | 0.04 | 0.1 | 5 mL | 150 |
| Example 9-2) | ZnO | EF-104 | BT | 0.04 | 0.1 | 5 mL | 140 |
| Example 9-3) | CdO | EF-104 | BT | 0.04 | 0.1 | 5 mL | 140 |
| Example 9-4) | CaO | EF-104 | BT | 0.04 | 0.1 | 5 mL | 130 |
| Example 9-5) | BaO | EF-104 | BT | 0.04 | 0.1 | 5 mL | 110 |
| Example 9-6) | MgO | EF-122 | BT | 0.04 | 0.1 | 5 mL | 140 |
| Example 9-7) | MgO | EF-132 | BT | 0.04 | 0.1 | 5 mL | 140 |
| Example 9-8) | MgO | EF-104 | IZ | 0.04 | 0.1 | 5 mL | 130 |
| Example 9-9) | MgO | EF-104 | BI | 0.04 | 0.1 | 5 mL | 140 |
| Example 9-10) | MgO | EF-104 | TU | 0.04 | 0.1 | 5 mL | 120 |
| Example 9-11) | MgO | EF-104 | MI | 0.04 | 0.1 | 5 mL | 130 |
| Example 9-12) | MgO | EF-104 | OA | 0.04 | 0.1 | 5 mL | 120 |
| Example 9-13) | MgO | EF-104 | TA | 0.04 | 0.1 | 5 mL | 120 |
| Example 8-14) | MgO | EF-104 | TL | 0.04 | 0.1 | 5 mL | 130 |
| Example 9-15) | MgO | EF-104 | ID | 0.04 | 0.1 | 5 mL | 110 |
| Example 9-16) | MgO | EF-104 | MP | 0.04 | 0.1 | 5 mL | 140 |
| Example 10-1) | MgO | EF-104 | BT | 0.01 | 0.1 | 5 mL | 140 |
| Example 10-2) | MgO | EF-104 | BT | 0.04 | 0.1 | 5 mL | 150 |
| Example 10-3) | MgO | EF-104 | BT | 0.5 | 0.1 | 5 mL | 120 |

TABLE 4-continued

| Characteristics of powder magnet from magnetic powder formed with phosphotized film | | | | | | | |
|---|---|---|---|---|---|---|---|
| Example 11-1) | MgO | EF-104 | BT | 0.04 | 0.01 | 5 mL | 130 |
| Example 11-2) | MgO | EF-104 | BT | 0.04 | 0.1 | 5 mL | 150 |
| Example 11-3) | MgO | EF-104 | BT | 0.04 | 1 | 5 mL | 90 |
| Example 12-1) | MgO | EF-104 | BR | 0.04 | 0.1 | 2.5 mL | 140 |
| Example 12-2) | MgO | EF-104 | BT | 0.04 | 0.1 | 5 mL | 150 |
| Example 12-3) | MgO | EF-104 | BT | 0.04 | 0.1 | 30 mL | 140 |

| Processing solution | Specific resistance (Ωcm) | Residual magnetic flux density (KG) | Coercivity (KOe) | Irreversible heat demagnetization rate (%) |
|---|---|---|---|---|
| Example 9-1) | 0.038 | 6.8 | 12.2 | <1 |
| Example 9-2) | 0.036 | 6.8 | 12.2 | <1 |
| Example 9-3) | 0.034 | 6.8 | 12.2 | <1 |
| Example 9-4) | 0.036 | 6.8 | 12.2 | <1 |
| Example 9-5) | 0.031 | 6.8 | 12.1 | <1 |
| Example 9-6) | 0.036 | 6.7 | 12 | <1 |
| Example 9-7) | 0.035 | 6.8 | 12.1 | <1 |
| Example 9-8) | 0.036 | 6.8 | 12.1 | <1 |
| Example 9-9) | 0.036 | 6.7 | 12 | <1 |
| Example 9-10) | 0.031 | 6.6 | 11.8 | <1 |
| Example 9-11) | 0.034 | 6.7 | 12 | <1 |
| Example 9-12) | 0.033 | 6.7 | 11.9 | < |
| Example 9-13) | 0.032 | 6.7 | 12 | <1 |
| Example 8-14) | 0.03 | 6.6 | 11.7 | <1 |
| Example 9-15) | 0.03 | 6.6 | 11.8 | <1 |
| Example 9-16) | 0.035 | 6.7 | 12 | <1 |
| Example 10-1) | 0.031 | 6.7 | 12 | <1 |
| Example 10-2) | 0.038 | 6.8 | 12.2 | <1 |
| Example 10-3) | 0.041 | 6.8 | 12.2 | <1 |
| Example 11-1) | 0.03 | 6.8 | 12.2 | <1 |
| Example 11-2) | 0.038 | 6.8 | 12.2 | <1 |
| Example 11-3) | 0.045 | 6.8 | 12.2 | <1 |
| Example 12-1) | 0.03 | 6.6 | 11.8 | <1 |
| Example 12-2) | 0.038 | 6.8 | 12.2 | <1 |
| Example 12-3) | 0.075 | 6.6 | 12.2 | <1 |

(1) Five mL of phosphatized solution was added to 100 g of the magnetic powder prepared by crushing an NdFeB-based ribbon and mixed until wetness of all the magnetic powder for rare-earth magnet was confirmed.

(2) The magnetic powder for rare-earth magnet, which underwent the phosphatized film formation treatment as described in (1), was heated for 30 min at 180° C. under reduced pressure of 2-5 torr.

For the $SiO_2$ precursor, which is binding agent, 25 ml of $CH_3O—(Si(CH_3O)_2—O)_m—CH_3$ (m is 3-5, average 4), 4.8 ml of water, 75 ml of dehydrated methanol, and 0.05 ml of dibutyltin dilaurate were mixed and left standing at a temperature of 25° C. for 2 days.

(1) The magnetic powder of $Nd_2Fe_{14}B$ that was coated with the phosphatized coat film was placed in molds, and a test piece for measuring the magnetic characteristic with a dimension of 10 mm length, 10 mm width and 5 mm thickness and a compression molded test piece for measuring the strength with a dimension of 15 mm length, 10 mm width and 2 mm thickness were produced under the pressure of 16 $t/cm^2$.

(2) The compression molded test pieces prepared in (1) described above were disposed in a vat so that the direction of pressure application was horizontal, and the binding agent, $SiO_2$ precursor solution left standing for 2 days at a temperature of 25° C. was poured into the vat at a rate of liquid surface rising vertically 1 mm/min until reaching to 5 mm above the upper face of the compression molded test pieces.

(3) The vat from (2) containing the compression molded test pieces and filled with the $SiO_2$ precursor solution was set in a vacuum chamber, and the air was exhausted slowly to about 80 Pa. The vat was left standing until few bubbles were generated from the surface of the compression molded test pieces.

(4) Internal pressure of the vacuum chamber, in which the vat containing the compression molded test pieces and filled with the $SiO_2$ precursor solution was set, was slowly returned to atmospheric pressure, and the compression molded test pieces were taken out of the $SiO_2$ precursor solution.

(5) The compression molded test piece which was infiltrated with the $SiO_2$ precursor solution produced in (4) described above was set inside a vacuum drying oven, and vacuum heating of the compression molded test piece was conducted under the conditions of a pressure of 1-3 Pa and a temperature of 150° C.

(6) The specific resistance of the compression molded test piece of 10 mm length, 10 mm width, 5 mm thickness that was produced in (5) described above was measured by the 4 probe method.

(7) Further, a pulse magnetic field of 30 kOe or greater was applied to the compression molded test piece which was subjected to the specific resistance measurement as described above, and the magnetic characteristic of the compression molded test piece was investigated.

(8) Using the compression molded test piece of 15 mm length, 10 mm width, 2 mm thickness produced in (5) described above, a mechanical bending test was implemented. For the bending test, amples of the compression molded body with a form of 15 mm×10 mm×2 mm was used to evaluate the flexural strength by a 3 point flex test with a point distance of 12 mm.

With regard to the magnetic characteristic of the compression molded test piece of 10 mm length, 10 mm width, 5 mm thickness produced in (5), the residual magnetic flux density was improved 20-30% when compared to the resin containing bond magnet (comparative example 1). When the demagnetization curve was measured at 20° C., the values of the residual magnetic flux density and coercivity were approximately the same between the molded products before and after $SiO_2$ infiltration and heat treatment. In addition, the heat demagnetization rate after 1 hour at 200° C. under atmosphere was 3.0% for the $SiO_2$ infiltrated bond magnet, which was lower than that of the bond magnet without $SiO_2$ infiltration (5%). Furthermore, after 1 hour at 200° C. in atmosphere, the irreversible heat demagnetization rate was 1% or less for the $SiO_2$ infiltration heat-treated magnet which was less than the nearly 3% for the magnet without $SiO_2$ infiltration. This is because the $SiO_2$ prevents deterioration from oxidation of the magnetic powder.

The flexural strength of the compressed molded test piece of 15 mm length, 10 mm width, 2 mm thickness produced in (7) described above was 2 MPa or less prior to $SiO_2$ infiltration. However, after $SiO_2$ infiltration and heat treatment, a molded magnetic product having a flexural strength of 100 MPa or greater could be produced.

Furthermore, the magnet of the present invention has a specific resistance value that is approximately 100 times or greater compared to that of sintered rare-earth magnets. Even compared with the compression-type rare-earth bond magnet, similar values were achieved.

Therefore, the characteristics are favorable with minimal eddy current loss.

As seen from the results of the present example, with the present invention, in which a low viscosity $SiO_2$ precursor is infiltrated into a rare-earth molded magnet product which is produced without resin and by a cold molding method, magnetic characteristics of the rare-earth bond magnet were improved 20-30%, flexural strength was approximately tripled, and the irreversible heat demagnetization rate was reduced to half or less as compared with the standard resin containing rare-earth bond magnet, and a magnet which was much more reliable could be produced.

EXAMPLE 10

In the present example, as in Example 1, a magnetic powder prepared by grinding a thin ribbon of NdFeB was used for the rare-earth magnetic powder.

The treatment solution which forms the phosphatization film was produced as follows.

20 g of phosphoric acid, 4 g of boric acid, 4 g of MgO as the metal oxide were dissolved in 1 L of water. For the surfactant, EF-104 (manufactured by Tochem Products) was added to achieve 0.1 wt %. As an antirust agent, benzotriazole (BT) was used. This was added to achieve a concentration of 0.01 to 0.5 mol/L.

The formation of a phosphatization film on the magnetic powder of $Nd_2Fe_{14}B$ was implemented by the following process.

(1) For 100 g of magnetic powder which was obtained by grinding a NdFeB thin ribbon, 5 mL of phosphatization solution was added. This was mixed until all of the magnetic powder for the rare-earth magnet was confirmed to be wet.

(2) Heat treatment of the magnetic powder for the rare-earth magnet which has had phosphatization film formation treatment according to (1) described above was conducted at 180° C. for 30 minutes under a reduced pressure of 2-5 torr.

For the $SiO_2$ precursor which is the binding agent, 25 ml of $CH_3O—(Si(CH_3O)_2—O)_m—CH_3$ (m is 3-5, average of 4), 4.8 ml of water, 75 ml of dehydrated methanol, and 0.05 ml of dibutyltin dilaurate were mixed, and this was left for 2 days at 25° C.

(1) Molds were filled with $Nd_2Fe_{14}B$ magnetic powder which had had phosphatization film formation treatment as described above. Under pressure of 16 t/cm$^2$, a test piece of 10 mm length, 10 mm width, 5 mm thickness which will be used for measuring the magnetic characteristics and a compression molded test piece of 15 mm length, 10 mm width, 2 mm thickness which will be used to measure strength were produced.

(2) The compression molded test pieces produced in (1) described above were placed in a vat so that the pressurizing direction was horizontal. The $SiO_2$ precursor solution, which is the binding agent and which had been left for 2 days at a temperature of 25° C., was poured into the vat at a rate of liquid surface rising vertically of 1 mm/min until reaching to 5 mm above the upper face of the compression molded test piece.

(3) The compression molded test piece used in the above (2) was positioned, and the vat filled with the $SiO_2$ precursor solution was set inside a vacuum chamber. The air was exhausted slowly to approximately 80 Pa. The vat was left standing until few bubbles were generated from the surface of the compression molded test piece.

(4) The internal pressure of the vacuum chamber, in which the vat containing the compression molded test piece and filled with the $SiO_2$ precursor solution was set, was raised gradually to atmospheric pressure. The compression molded test piece was removed from the $SiO_2$ precursor solution.

(5) The compression molded test piece which was infiltrated with $SiO_2$ precursor solution as produced in (4) described above was set inside a vacuum drying oven, and vacuum heating of the compression molded test piece was conducted under the conditions of a pressure of 1-3 Pa and a temperature of 150° C.

(6) The specific resistance of the compression molded test piece of 10 mm length, 10 mm width, 5 mm thickness that was produced in (5) described above was measured by the 4 probe method.

(7) Further, a pulse magnetic field of 30 kOe or greater was applied to the compression molded test piece which was subjected to the specific resistance measurement as described above, and the magnetic characteristic of the compression molded test piece was investigated.

(8) Using the compression molded test piece of 15 mm length, 10 mm width, 2 mm thickness produced in (5) described above, a mechanical bending test was implemented. For the bending test, amples of the compression molded body with a form of 15 mm×10 mm×2 mm was used to evaluate the flexural strength by a 3 point flex test with a point distance of 12 mm.

With regard to the magnetic characteristic of the compression molded test piece of 10 mm length, 10 mm width, 5 mm thickness produced in (5) described above, the residual magnetic flux density was improved 20-30% when compared to the resin containing bond magnet (comparative example 1). When the demagnetization curve was measured at 20° C., the values of the residual magnetic flux density and coercivity were approximately the same between the molded products before and after $SiO_2$ infiltration and heat treatment. In addition, the heat demagnetization rate after 1 hour at 200° C. under atmosphere was 3.0% for the $SiO_2$ infiltrated bond magnet, which was lower than that of the bond magnet without $SiO_2$ infiltration (5%). Furthermore, after 1 hour at 200° C. in atmosphere, the irreversible heat demagnetization rate was 1% or less for the $SiO_2$ infiltration heat-treated magnet which was less than the nearly 3% for the magnet without $SiO_2$ infiltration. This is because the $SiO_2$ prevents deterioration from oxidation of the magnetic powder.

The flexural strength of the compression molded test piece of 15 mm length, 10 mm width, 2 mm thickness produced in (7) described above was 2 MPa or less prior to $SiO_2$ infiltration. However, after $SiO_2$ infiltration and heat treatment, a molded magnetic product having a flexural strength of 100 MPa or greater could be produced.

Furthermore, the magnet of the present invention has a specific resistance value that is approximately 100 times or greater compared to that of sintered rare-earth magnets. Even compared with the compression-type rare-earth bond magnet, similar values were achieved. Therefore, the characteristics are favorable with minimal eddy current loss.

As seen from the results of the present example, with the present invention, in which a low viscosity $SiO_2$ precursor is infiltrated into a rare-earth molded magnet product which is produced without resin and by a cold molding method, magnetic characteristics of the rare-earth bond magnet were improved 20-30%, flexural strength was approximately tripled, and the irreversible heat demagnetization rate was reduced to half or less as compared with the standard resin containing rare-earth bond magnet, and a magnet which was much more reliable could be produced.

EXAMPLE 11

In the present example, as in Example 1, a magnetic powder prepared by grinding a thin ribbon of NdFeB was used for the rare-earth magnetic powder.

The treatment solution which forms the phosphatization film was produced as follows.

20 g of phosphoric acid, 4 g of boric acid, 4 g of MgO as the metal oxide were dissolved in 1 L of water. As an antirust agent, benzotriazole (BT) was added to achieve a concentration of 0.04 mol/L. For the surfactant, EF-104 (manufactured by Tochem Products) was added to achieve a concentration of 0.01 wt % to 1 wt %.

The formation of a phosphatization film on the magnetic powder of $Nd_2Fe_{14}B$ was implemented by the following process.

(1) For 100 g of magnetic powder which was obtained by grinding a NdFeB thin ribbon, 5 mL of phosphatization treatment solution was added. This was mixed until all of the magnetic powder for the rare-earth magnet was confirmed to be wet.

(2) Heat treatment of the magnetic powder for the rare-earth magnet which has had phosphatization film formation treatment according to (1) was conducted at 180° C. for 30 minutes under a reduced pressure of 2-5 torr.

For the $SiO_2$ precursor which is the binding agent, 25 ml of $CH_3O—(Si(CH_3O)_2—O)_m—CH_3$ (m is 3-5, average of 4), 4.8 ml of water, 75 ml of dehydrated methanol, and 0.05 ml of dibutyltin dilaurate were mixed, and this was left for 2 days at 25° C.

(1) Molds were filled with $Nd_2Fe_{14}B$ magnetic powder which had had phosphatization film formation treatment as described above. Under pressure of 16 t/cm$^2$, a test piece of 10 mm length, 10 mm width, 5 mm thickness which will be used for measuring the magnetic characteristics and a compression molded test piece of 15 mm length, 10 mm width, 2 mm thickness which will be used to measure strength were produced.

(2) The compression molded test pieces produced in (1) described above were placed in a vat so that the pressurizing direction was horizontal. The $SiO_2$ precursor solution, which is the binding agent and which had been left for 2 days at a temperature of 25° C., was poured into the vat at a rate of liquid surface rising vertically of 1 mm/min until reaching to 5 mm above the upper face of the compression molded test piece.

(3) The compression molded test piece used in the above (2) was positioned, and the vat filled with the $SiO_2$ precursor solution was set inside a vacuum chamber. The air was exhausted slowly to approximately 80 Pa. The vat was left standing until few bubbles were generated from the surface of the compression molded test piece.

(4) The internal pressure of the vacuum chamber, in which the vat containing the compression molded test piece and filled with the $SiO_2$ precursor solution was set, was raised gradually to atmospheric pressure. The compression molded test piece was removed from the $SiO_2$ precursor solution.

(5) The compression molded test piece which was infiltrated with $SiO_2$ precursor solution as produced in (4) described above was set inside a vacuum drying oven, and vacuum heating of the compression molded test piece was conducted under the conditions of a pressure of 1-3 Pa and a temperature of 150° C.

(6) The specific resistance of the compression molded test piece of 10 mm length, 10 mm width, 5 mm thickness that was produced in (5) described above was measured by the 4 probe method.

(7) Further, a pulse magnetic field of 30 kOe or greater was applied to the compression molded test piece which was subjected to the specific resistance measurement as described above, and the magnetic characteristic of the compression molded test piece was investigated.

(8) Using the compression molded test piece of 15 mm length, 10 mm width, 2 mm thickness produced in (5) described above, a mechanical bending test was implemented. For the bending test, amples of the compression molded body with a form of 15 mm×10 mm×2 mm was used to evaluate the flexural strength by a 3 point flex test with a point distance of 12 mm.

With regard to the magnetic characteristic of the compression molded test piece of 10 mm length, 10 mm width, 5 mm thickness produced in (5), the residual magnetic flux density was improved 20-30% when compared to the resin containing bond magnet (comparative example 1). When the demagnetization curve was measured at 20° C., the values of the residual magnetic flux density and coercivity were approximately the same between the molded products before and after $SiO_2$ infiltration and heat treatment. In addition, the heat demagnetization rate after 1 hour at 200° C. under atmosphere was 3.0% for the $SiO_2$ infiltrated bond magnet, which was lower than that of the bond magnet without $SiO_2$ infiltration (5%). Furthermore, after 1 hour at 200° C. in atmosphere, the irreversible heat demagnetization rate was 1% or less for the $SiO_2$ infiltration heat-treated magnet and this was less than the nearly 3% for the magnet without $SiO_2$ infiltration. This is because the $SiO_2$ prevents deterioration from oxidation of the magnetic powder.

The flexural strength of the compression molded test piece of 15 mm length, 10 mm width, 2 mm thickness produced in (7) described above was 2 MPa or less prior to $SiO_2$ infiltration. However, after $SiO_2$ infiltration and heat treatment, a molded magnetic product having a flexural strength of 90 MPa or greater could be produced.

Furthermore, the magnet of the present invention has a specific resistance value that is approximately 100 times or greater compared to that of sintered rare-earth magnets. Even compared with the compression-type rare-earth bond magnet, similar values were achieved. Therefore, the characteristics are favorable with minimal eddy current loss.

As seen from the results of the present example, with the present invention, in which a low viscosity $SiO_2$ precursor is infiltrated into a rare-earth molded magnet product which is produced without resin and by a cold molding method, magnetic characteristics of the rare-earth bond magnet were improved 20-30%, flexural strength was approximately tripled, and the irreversible heat demagnetization rate was reduced to half or less as compared with the standard resin containing rare-earth bond magnet, and a magnet which was much more reliable could be produced.

EXAMPLE 12

In the present example, as in Example 1, a magnetic powder prepared by grinding a thin ribbon of NdFeB was used for the rare-earth magnetic powder.

The treatment solution which forms the phosphatization film was produced as follows.

Twenty g of phosphoric acid, 4 g of boric acid, 4 g of MgO as the metal oxide were dissolved in 1 L of water. For the surfactant, EF-104 (manufactured by Tochem Products) was added to achieve 0.1 wt %. As an antirust agent, benzotriazole (BT) was added to achieve a concentration of 0.04 mol/L.

The formation of a phosphatization film on the magnetic powder of $Nd_2Fe_{14}B$ was implemented by the following process.

(1) For 100 g of magnetic powder which was obtained by grinding a NdFeB thin ribbon, 2.5-30 mL of phosphatization solution was added. This was mixed until all of the magnetic powder for the rare-earth magnet was confirmed to be wet.

(2) Heat treatment of the magnetic powder for the rare-earth magnet which has had phosphatization film formation treatment according to (1) was conducted at 180° C. for 30 minutes under a reduced pressure of 2-5 torr.

For the $SiO_2$ precursor which is the binding agent, 25 ml of $CH_3O—(Si(CH_3O)_2—O)_m—CH_3$ (m is 3-5, average of 4), 4.8 ml of water, 75 ml of dehydrated methanol, and 0.05 ml of dibutyltin dilaurate were mixed, and this was left for 2 days at 25° C.

(1) Molds were filled with $Nd_2Fe_{14}B$ magnetic powder which had had phosphatization film formation treatment as described above. Under pressure of 16 t/cm$^2$, a test piece of 10 mm length, 10 mm width, 5 mm thickness which will be used for measuring the magnetic characteristics and a compression molded test piece of 15 mm length, 10 mm width, 2 mm thickness which will be used to measure strength were produced.

(2) The compression molded test pieces produced in (1) described above were placed in a vat so that the pressurizing direction was horizontal. The $SiO_2$ precursor solution, which is the binding agent and which had been left for 2 days at a temperature of 25° C., was poured into the vat at a rate of liquid surface rising vertically of 1 mm/min until reaching 5 mm above the upper face of the compression molded test piece.

(3) The compression molded test piece used in the above (2) was positioned, and the vat filled with the $SiO_2$ precursor solution was set inside a vacuum chamber. The air was exhausted slowly to approximately 80 Pa. The vat was left standing until few bubbles were generated from the surface of the compression molded test piece.

(4) The internal pressure of the vacuum chamber, in which the vat containing the compression molded test piece and filled with the $SiO_2$ precursor solution was set, was raised gradually to atmospheric pressure. The compression molded test piece was removed from the $SiO_2$ precursor solution.

(5) The compression molded test piece which was infiltrated with $SiO_2$ precursor solution as produced in (4) described above was set inside a vacuum drying oven, and vacuum heating of the compression molded test piece was conducted under the conditions of a pressure of 1-3 Pa and a temperature of 150° C.

(6) The specific resistance of the compression molded test piece of 10 mm length, 10 mm width, 5 mm thickness that was produced in (5) described above was measured by the 4 probe method.

(7) Further, a pulse magnetic field of 30 kOe or greater was applied to the compression molded test piece which was subjected to the specific resistance measurement as described above, and the magnetic characteristic of the compression molded test piece was investigated.

(8) Using the compression molded test piece of 15 mm length, 10 mm width, 2 mm thickness produced in (5) described above, a mechanical bending test was implemented. For the bending test, amples of the compression molded body with a form of 15 mm×10 mm×2 mm was used to evaluate the flexural strength by a 3 point flex test with a point distance of 12 mm.

With regard to the magnetic characteristic of the compression molded test piece of 10 mm length, 10 mm width, 5 mm thickness produced in (5) described above, the residual magnetic flux density was improved 20-30% when compared to the resin containing bond magnet (comparative example 1). When the demagnetization curve was measured at 20° C., the values of the residual magnetic flux density and coercivity were approximately the same between the molded products before and after $SiO_2$ infiltration and heat treatment. In addition, the heat demagnetization rate after 1 hour at 200° C. under atmosphere was 3.0% for the $SiO_2$ infiltrated bond magnet, which was lower than that of the bond magnet without $SiO_2$ infiltration (5%). Furthermore, after 1 hour at 200° C. in atmosphere, the irreversible heat demagnetization rate was 1% or less for the $SiO_2$ infiltration heat-treated magnet which was less than the nearly 3% for the magnet without $SiO_2$ infiltration. This is because the $SiO_2$ prevents deterioration from oxidation of the magnetic powder.

The flexural strength of the compression molded test piece of 15 mm length, 10 mm width, 2 mm thickness produced in (7) described above was 2 MPa or less prior to $SiO_2$ infiltration. However, after $SiO_2$ infiltration and heat treatment, a molded magnetic product having a flexural strength of 100 MPa or greater could be produced.

Furthermore, the magnet of the present invention has a specific resistance value that is approximately 100 times or greater compared to that of sintered rare-earth magnets. Even compared with the compression-type rare-earth bond magnet, similar values were achieved. Therefore, the characteristics are favorable with minimal eddy current loss.

As seen from the results of the present example, with the present invention, in which a low viscosity $SiO_2$ precursor is infiltrated into a rare-earth molded magnet product which is produced without resin and by a cold molding method, magnetic characteristics of the rare-earth bond magnet were improved 20-30%, flexural strength was approximately tripled, and the irreversible heat demagnetization rate was reduced to half or less as compared with the standard resin containing rare-earth bond magnet, and a magnet which was much more reliable could be produced.

COMPARATIVE EXAMPLE 1

In the present comparative example, as in Example 1, a magnetic powder prepared by grinding a thin ribbon of NdFeB was used for the rare-earth magnetic powder.

(1) Solid epoxy resin (EPX 6136 by Somar Co.) with a size of 100 micrometers or less was mixed at 0 to 20% by volume with the rare-earth magnetic powder using a V mixer.

(2) Dies were filled with the compound of rare-earth magnetic powder and resin as produced in (1) described above. In an inert gas atmosphere and a molding pressure of 16 t/cm$^2$, heat compression molding was conducted at 80° C. The magnets that were produced were of sizes 10 mm length, 10 mm width, 5 mm thickness which will be used for measuring the magnetic characteristics and 15 mm length, 10 mm width, 2 mm thickness which will be used to measure strength.

(3) The setting of the resin of the bond magnet produced in (2) described above was conducted in a nitrogen atmosphere at 170° C. for 1 hour.

(4) The specific resistance of the compression molded test piece of 10 mm length, 10 mm width, 5 mm thickness that was produced in (3) described above was measured by the 4 probe method.

(5) Further, a pulse magnetic field of 30 kOe or greater was applied to the compression molded test piece which was subjected to the specific resistance measurement as described above, and the magnetic characteristic of the compression molded test piece was investigated.

(6) Using the compression molded test piece of 15 mm length, 10 mm width, 2 mm thickness produced in (3) described above, a mechanical bending test was implemented. For the bending test, amples of the compression molded body with a form of 15 mm×10 mm×2 mm was used to evaluate the flexural strength by a 3 point flex test with a point distance of 12 mm.

The magnetic characteristic of the compression molded test piece of 10 mm length, 10 mm width, 5 mm thickness produced in (4) described above was investigated. As the epoxy resin content in the magnet increased, the residual magnetic flux density of the magnet decreased. When compared with the bond magnet produced by $SiO_2$ binding agent infiltration (Examples 1-5), with magnets with a flexure strength of 50 MPa or greater, the epoxy resin containing bond magnets had a magnetic flux density which was lower by 20-30%. In addition, the heat demagnetization rate after 1 hour at 200° C. under atmosphere was 5% for the epoxy resin containing bond magnet, and this was higher than the $SiO_2$ infiltrated bond magnet which was 3.0%. Furthermore, after 1 hour at 200° C. in atmosphere and then remagnetizing after returning to room temperature, the irreversible heat demagnetization rate was less than 1% for the infiltration heat-treated magnet (Examples 1-5), and in contrast, the epoxy resin containing bond magnet (Comparative Example 1) was large at a value of almost 3%. Not only the irreversible heat demagnetization rate was suppressed, but even with PCT tests and saline atomization tests, the epoxy resin containing bond magnet was at a lower level compared to $SiO_2$ infiltrated bond magnets.

Furthermore, the compression molded test piece of 10 mm length, 10 mm width, 5 mm thickness described in (4) described above was maintained in atmosphere at 225° C. for 1 hour, and after cooling to 20° C., the demagnetization curve was measured. The magnetic field was applied in the direction of the 10 mm direction. After an initial magnetization with a magnetic field of +20 kOe, a magnetic field of ±1 kOe to ±10 kOe was applied with alternating plus and minus, and the demagnetization curve was measured. The results are shown in FIG. 4. In FIG. 4, the demagnetization curves for the magnet infiltrated with $SiO_2$ under conditions of (2) of Example 1 and a compression molded bond magnet containing a 15 vol % of epoxy resin as a binder as in the present Comparative Example are compared. In FIG. 4, the horizontal axis is the magnetic field that is applied and the vertical axis is the magnetic flux density. The magnetic flux of the magnet infiltrated with $SiO_2$ binding agent decreased dramatically when a magnetic field more negative than −8 kOe was applied. With the compression molded bond magnet, there was a dramatic reduction in magnetic flux at a magnetic field with an absolute value that was smaller than that of the infiltration magnet, and it showed a dramatic decrease of magnetic flux at a magnetic field that was more negative than −5 kOe. The residual magnetic flux density after applying a magnetic field of −10 kOe was 0.44 for the infiltration heat-treated magnet, 0.11 T for the compression molded bond magnet. The infiltration heat-treated magnet had a residual magnetic flux density of 4 times the value of the compression molded bond magnet. With the compression molded bond magnet, during heating to 225° C., the surface of each NdFeB powder or the crack surface of the NdFeB powder was oxidized, and magnetic anisotropy of the NdFeB crystals which construct each NdFeB powder was reduced. As a result, the coercivity was reduced, and with the application of a negative magnetic field, the magnetization was readily reversed. In contrast, it is considered that, with the infiltrated magnet, the NdFeB powder and the crack surfaces are covered with a $SiO_2$ film, and as a result, oxidation during heating in atmosphere is prevented, and there is less reduction in the coercivity.

The flexure strength of the compression molded test piece of 15 mm length, 10 mm width, 2 mm thickness that was produced in (7) described above increased when the epoxy resin content of the binding agent increased, and at a volume content of 20 vol %, the flexure strength of the magnet became 48 MPa. The necessary flexure strength for a bonded magnet is achieved.

When comparing the level of specific resistance of the $SiO_2$ infiltrated bond magnet and the epoxy resin containing bond magnet, they were the same.

As seen from the results of the present comparative example, compared with the rare-earth bond magnet of the present invention in which a low viscosity $SiO_2$ precursor is infiltrated into a rare-earth molded magnet product which is produced without resin and by a cold molding method, the epoxy resin containing rare-earth bond magnet had magnetic characteristics that were 20-30% lower. It was found that the irreversible heat demagnetizing rate and the reliability of the magnet was low.

In the present comparative example, the volume ratios of the resin (the volume ratio of the resin in the resin and rare-earth magnetic powder) were changed, and the bond magnets containing epoxy resin were evaluated. These results are summarized in Table 5.

TABLE 5

Various characteristics of the bond magnet using epoxy resin

| Binding agent | Epoxy resin material | Volume ratio (vol %) of the resin | Flexure strength (MPa) | Specific resistance (Ωcm) | Residual magnetic flux density (kG) | Coercivity (kOe) | Irreversible heat demagnetization rate (%) |
|---|---|---|---|---|---|---|---|
| Comparative Example 1-1) | — | 0 | 1.8 | 0.0015 | 6.9 | 12.2 | 3.5 |
| Comparative Example 1-2) | EPX6136 | 5 | 5.1 | 0.0016 | 6.3 | 11.9 | 2.9 |
| Comparative Example 1-3) | EPX6136 | 10 | 12 | 0.0018 | 6.1 | 11.8 | 2.8 |
| Comparative Example 1-4) | EPX6136 | 15 | 29 | 0.0022 | 5.7 | 11.7 | 2.6 |
| Comparative Example 1-5) | EPX6136 | 20 | 48 | 0.0031 | 5.4 | 11.7 | 2.5 |

COMPARATIVE EXAMPLE 2

In the present comparative example, as in Example 1, a magnetic powder prepared by grinding a thin ribbon of NdFeB was used for the rare-earth magnetic powder.

The binding agent, $SiO_2$ precursor, was prepared by mixing 1 ml of $CH_3O—(Si(CH_3O)_2—O)_m—CH_3$ (m is 3-5, average 4), 0.19 ml of water, 99 ml of dehydrated methanol and 0.05 ml of dibutyltin dilaurate and left standing at 25° C. for 2 days, and the resulting $SiO_2$ precursor solution was used.

Viscosity of the $SiO_2$ precursor solution described above was measured using an Ostwald viscometer at a temperature of 30° C.

(1) Compression molded test pieces of 10 mm length, 10 mm width and 5 mm thickness for magnetic characteristic measurement and of 15 mm length, 10 mm width and 2 mm thickness for strength measurement were produced by filling molds with the $Nd_2Fe_{14}B$ described above and applying pressure at 16 t/cm$^2$.

(2) The compression molded test pieces produced in (1) described above were disposed in a vat so that the direction of pressure application was horizontal, and the binding agent, $SiO_2$ precursor solution described above was poured into the vat at a rate of liquid surface rising vertically 1 mm/min until reaching 5 mm above the upper face of the compression molded test piece.

(3) The vat containing the compression molded test piece used in (2) described above and filled with the $SiO_2$ precursor solution was set in a vacuum chamber, and the air was exhausted slowly to about 80 Pa. The vat was left standing until few bubbles were generated from the surface of the compression molded test piece.

(4) Internal pressure of the vacuum chamber, in which the vat containing the compression molded test piece and filled with the $SiO_2$ precursor solution was set, was slowly returned to atmosphere, and the compression molded test piece was taken out of the $SiO_2$ precursor solution.

(5) The compression molded test piece that was infiltrated with the $SiO_2$ precursor solution prepared in (4) described above was set in a vacuum drying oven and treated under the condition of the pressure 1-3 Pa and temperature of 150° C.

(6) The specific resistance of the compression molded test piece of 10 mm length, 10 mm width and 5 mm thickness that was produced in (5) described above was measured by the 4 probe method.

(7) Further, a pulse magnetic field of 30 kOe or above was applied to the compression molded test piece which was subjected to the specific resistance measurement as described above, and the magnetic characteristic of the compression molded test piece was investigated.

(8) A mechanical bending test was conducted using a compression molded test piece of 15 mm length, 10 mm width and 2 mm thickness that was produced in (5) described above. A sample of the compression molded piece with a form of 15 mm×10 mm×2 mm was subjected to bending tests to evaluate flexural strength by 3 point bending tests with 12 mm distance between the points.

With regard to the magnetic characteristic of the compression molded test piece of 10 mm length, 10 mm width, 5 mm thickness produced in (5) described above, the residual magnetic flux density was improved 20-30% when compared to the resin containing bond magnet (comparative example 1). When the demagnetization curve was measured at 20° C., the values of the residual magnetic flux density and coercivity were approximately the same between the molded products before and after $SiO_2$ infiltration and heat treatment. In addition, the heat demagnetization rate after 1 hour at 200° C. under atmosphere was 3.0% for the $SiO_2$ infiltrated bond magnet, which was lower than that of the bond magnet without $SiO_2$ infiltration (5%). Furthermore, after 1 hour at 200° C. in atmosphere and then remagnetizing after returning to room temperature, the irreversible heat demagnetization rate was less than 1% for the $SiO_2$ infiltration heat-treated magnet and nearly 3% for the epoxy magnet (Comparative Example 1).

However, the flexural strength of the compression molded test piece of 15 mm length, 10 mm width, 2 mm thickness produced in (7) described above was low. The $SiO_2$ infiltrated bond magnet of the present comparative example only had about 1/10 the value of flexural strength compared with that of the bond magnet containing epoxy resin. This is because, in the present comparative example, the $SiO_2$ precursor content in the binding agent is 1 vol %, and it is 1-2 digits less as compared with the $SiO_2$ precursor content in the binding agent of the examples. As a result, even though the flexural strength of the $SiO_2$ elementary substance is large after hardening, the content in the magnet is too low.

In conclusion, the magnet of the present comparative example has the shortcoming that the magnet strength is low.

The various characteristics of the present comparative example as well as 1) and 2) of (comparative example 3) and (comparative example 4) which will be described later are summarized in Table 6.

TABLE 6

Various characteristics of magnets which have been infiltrated using $SiO_2$ precursor material

| Binding agent | Binding agent composition: $SiO_2$ precursor material | Type of alcohol | Silicate compound (mL) | Water (mL) | Alcohol (mL) | Dibutyltin dilaurate (mL) |
|---|---|---|---|---|---|---|
| Comparative Example 2 | $CH_3O—(Si(CH_3O)_2—O)m—CH_3$, average m is 4 | Methanol | 1 | 0.19 | 99 | 0.05 |
| Comparative Example 3-1) | $CH_3O—(Si(CH_3O)_2—O)m—CH_3$, average m is 4 | Methanol | 25 | 0.19 | 75 | 0.05 |
| Comparative Example 3-2) | $CH_3O—(Si(CH_3O)_2—O)m—CH_3$, average m is 4 | Methanol | 25 | 24 | 75 | 0.05 |
| Comparative Example 4 | $CH_3O—(Si(CH_3O)_2—O)m—CH_3$, average m is 4 | Methanol | 25 | 9.6 | 75 | 0.05 |

| Binding agent | Viscosity (mPa · s) | Flexural strength (MPa) | Specific resistance (Ωcm) | Magnetic characteristics of the magnet: Residual magnetic flux density (kG) | Coercivity (kOe) | Irreversible heat demagnetization rate (%) |
|---|---|---|---|---|---|---|
| Comparative Example 2 | 0.87 | 4.2 | 0.0016 | 6.9 | 12.2 | <1 |
| Comparative Example 3-1) | 1.9 | 7.8 | 0.0017 | 6.9 | 12.2 | <1 |
| Comparative Example 3-2) | 350 | 170 | 0.0027 | 6.5 | 12.2 | 1.9 |
| Comparative Example 4 | 240 | 190 | 0.0032 | 6.6 | 12.2 | 1.6 |

COMPARATIVE EXAMPLE 3

In the present comparative example, as in Example 1, a magnetic powder prepared by grinding a thin ribbon of NdFeB was used for the rare-earth magnetic powder.

The following two solutions were used as the $SiO_2$ precursor, which is binding agent.

1) The $SiO_2$ precursor was prepared by mixing 25 ml of $CH_3O—(Si(CH_3O)_2—O)_m—CH_3$ (m is 3-5, average 4), 0.19 ml of water, 75 ml of dehydrated methanol and 0.05 ml of dibutyltin dilaurate and left standing at 25° C. for 2 days.

2) The $SiO_2$ precursor was prepared by mixing 25 ml of $CH_3O—(Si(CH_3O)_2—O)_m—CH_3$ (m is 3-5, average 4), 24 ml of water, 75 ml of dehydrated ethanol and 0.05 ml of dibutyltin dilaurate and left standing at 25° C. for 2 days.

Viscosity of the $SiO_2$ precursor solution of 1), 2) was measured using an Ostwald viscometer at a temperature of 30° C.

(1) Compression molded test pieces of 10 mm length, 10 mm width and 5 mm thickness for magnetic characteristic measurement and of 15 mm length, 10 mm width and 2 mm thickness for strength measurement were produced by filling molds with the $Nd_2Fe_{14}B$ described above and applying pressure at 16 t/cm$^2$.

(2) The compression molded test pieces produced in (1) described above were disposed in a vat so that the direction of pressure application was horizontal, and the binding agent, $SiO_2$ precursor solution 1) and 2) was poured into the vat at a rate of liquid surface rising vertically 1 mm/min until reaching 5 mm above the upper face of the compression molded test piece.

(3) The vat containing the compression molded test piece used in (2) described above and filled with the $SiO_2$ precursor solution was set in a vacuum chamber, and the air was exhausted slowly to about 80 Pa. The vat was left standing until few bubbles were generated from the surface of the compression molded test piece.

(4) Internal pressure of the vacuum chamber, in which the vat containing the compression molded test piece and filled with the $SiO_2$ precursor solution was set, was slowly returned to atmosphere, and the compression molded test piece was taken out of the $SiO_2$ precursor solution.

(5) The compression molded test piece that was infiltrated with the $SiO_2$ precursor solution prepared in (4) described above was set in a vacuum drying oven and treated under the condition of the pressure 1-3 Pa and temperature of 150° C.

(6) The specific resistance of the compression molded test piece of 10 mm length, 10 mm width and 5 mm thickness that was produced in (5) described above was measured by the 4 probe method.

(7) Further, a pulse magnetic field of 30 kOe or above was applied to the compression molded test piece which was subjected to the specific resistance measurement as described above, and the magnetic characteristic of the compression molded test piece was investigated.

(8) A mechanical bending test was conducted using a compression molded test piece of 15 mm length, 10 mm width and 2 mm thickness produced in (5) described above. A sample of the compression molded piece with a form of 15 mm×10 mm×2 mm was subjected to bending tests to evaluate flexural strength by 3 points bending tests with 12 mm distance between the points.

For the magnetic characteristic of compression molded test piece of 10 mm length, 10 mm width and 5 mm thickness produced in (5) described above (Comparative Example 3)-1), the residual magnetic flux density can be improved by 20-30% when compared to a resin containing bond magnet (comparative example 1), and in the demagnetization curve measured at 20° C., the values of residual magnetic flux density and coercivity were almost the same between the molded products before and after $SiO_2$ infiltration and heat treatment. Also, the rate of heat demagnetization after keeping for 1 hour at 200° C. under the atmosphere was 3.0% in the $SiO_2$ infiltrated bond magnet, which was lower than that in the bond magnet without $SiO_2$ infiltration (5%). Further, the irreversible heat demagnetization rate after treating the magnet at 200° C. for 1 hour, cooling to room temperature and then remagnetizing was less than 1% in the infiltration heat-treated magnet, while it was nearly 3% in the epoxy bond magnet (comparative example 1).

However, the flexural strength of the compression molded test piece of 15 mm length, 10 mm width and 2 mm thickness produced in (7) described above was low, and the $SiO_2$ infiltrated bond magnet of the present comparative example had about ⅙ strength compared to the epoxy resin containing bond magnet. Since the amount of water added to the binding agent was small in the present comparative example, hydrolysis of the methoxy group in the $SiO_2$ precursor material, shown in chemical formula 1, did not proceed, the silanol group was not generated, and the dehydration/condensation reaction between silanol groups in thermosetting of the $SiO_2$ precursor did not take place and thus the amount of generated $SiO_2$ after thermosetting was small, resulting in low flexural strength of the $SiO_2$ infiltrated bond magnet.

In conclusion, the magnet of (comparative example 3)-1) is difficult to use as a magnet due to weak magnetizing power.

For (comparative example 3)-2), the flexural strength of compression molded test piece of 15 mm length, 10 mm width and 2 mm thickness produced in (7) was 2 MPa or below before $SiO_2$ infiltration, but it was possible to produce a molded magnet product having a flexural strength of 170 MPa after $SiO_2$ infiltration heat treatment.

For the magnetic characteristic of the compression molded test piece of 10 mm length, 10 mm width and 5 mm thickness produced in (5), the residual magnetic flux density can be improved by 20% when compared to a resin containing bond magnet (comparative example 1), and in the demagnetization curve measured at 20° C., the values of residual magnetic flux density and coercivity were almost the same in the molded products before and after $SiO_2$ infiltration and heat treatment. However, the rate of heat demagnetization after keeping for 1 hour at 200° C. under the atmosphere was 4.0% in the present comparative example, which was greater than 3.0% of the $SiO_2$ infiltrated bond magnet of the Example. Further, the irreversible heat demagnetization rate after treating the magnet at 200° C. under the atmosphere for 1 hour, cooling to room temperature and then remagnetizing was less than 1% in the $SiO_2$ infiltration heat-treated magnet of the Example, while it was nearly 2% in the present comparative example. It was revealed that the $SiO_2$ precursor solution infiltrated into the magnet only a little more than about 1 mm from the surface of the magnet, and this influenced heat demagnetization. Thus, the magnetic powder in the center of the magnet deteriorated by oxidation during heating in an atmosphere, causing the magnet of the present comparative example to have a greater irreversible heat demagnetization rate than the magnet of the Example.

This result suggests that although the bond magnet of the present comparative example is not inferior to the conventional epoxy bond magnet, its long term reliability may be lower than the conventional epoxy resin bond magnet.

COMPARATIVE EXAMPLE 4

In the present comparative example, similarly to Example 1, the magnetic powder prepared by grinding a thin ribbon of NdFeB was used for producing the rare-earth magnet powder.

The binding agent, $SiO_2$ precursor, was prepared by mixing 25 ml of $CH_3O—(Si(CH_3O)_2—O)_m—CH_3$ (m is 3-5, average 4), 9.6 ml of water, 75 ml of dehydrated methanol and 0.05 ml of dibutyltin dilaurate and left standing at 25° C. for 6 days and the resulting $SiO_2$ precursor solution was used.

Viscosity of the $SiO_2$ precursor solution described above was measured using an Ostwald viscometer at 30° C.

(1) Molds were filled with the $Nd_2Fe_{14}B$ magnetic powder described above. Under pressure of 16 t/cm$^2$, a test piece of 10 mm length, 10 mm width, 5 mm thickness which will be used for measuring the magnetic characteristics and a compression molded test piece of 15 mm length, 10 mm width, 2 mm thickness which will be used to measure strength were produced.

(2) The compression molded test pieces produced in (1) described above were placed in a vat so that the pressurizing direction was horizontal. The $SiO_2$ precursor solution, which is the binding agent described above, was poured into the vat at a rate of liquid surface rising vertically 1 mm/min until reaching to 5 mm above the upper face of the compression molded test piece.

(3) The compression molded test piece used in the above (2) was positioned, and the vat filled with the $SiO_2$ precursor solution was set in a vacuum chamber. The air was exhausted slowly to about 80 Pa. The vat was left standing until few bubbles were generated from the surface of the compression molded test piece.

(4) The internal pressure of the vacuum chamber, in which the vat containing the compression molded test piece and filled with the $SiO_2$ precursor solution was set, was gradually returned to atmospheric pressure. The compression molded test piece was removed from the $SiO_2$ precursor solution.

(5) The compression molded test piece which was infiltrated with the $SiO_2$ precursor solution prepared in (4) described above was set in a vacuum drying oven and vacuum heating of the compression molded test piece was conducted at 1-3 Pa of pressure and 150° C.

(6) The specific resistance of the compression molded test piece of 10 mm length, 10 mm width and 5 mm thickness produced in (5) described above was measured by the 4 pin probe method.

(7) Further, a pulse magnetic field of 30 kOe or above was applied to the compression molded test piece which was subjected to the specific resistance measurement as described above, and the magnetic characteristic of the compression molded test piece was investigated.

(8) Using a compression molded test piece of 15 mm length, 10 mm width and 2 mm thickness produced in (5) described above, a mechanical bending test was implemented. For the bending test, a compression molded piece with a form of 15 mm×10 mm×2 mm was used to evaluate flexural strength by a 3 points flex test with a point distance of 12 mm.

The flexural strength of the compression molded test piece of 15 mm length, 10 mm width and 2 mm thickness produced in (7) described above was 2 MPa or below before the infiltration of $SiO_2$ but it was possible to produce a molded magnet product having a flexural strength of 190 MPa after $SiO_2$ infiltration heat treatment.

For the magnetic characteristic of the compression molded test piece of 10 mm length, 10 mm width and 5 mm thickness produced in (5) described above, the residual magnetic flux density can be improved by 20% when compared to a resin containing bond magnet (comparative example 1), and in the demagnetization curve measured at 20° C., the values of residual magnetic flux density and coercivity were almost the same in the molded products before and after $SiO_2$ infiltration and heat treatment. However, the rate of heat demagnetization after keeping for 1 hour at 200° C. under the atmosphere was 3.6% in the present comparative example, which is greater than the 3.0% of the $SiO_2$ infiltrated bond magnet in the Example. Further, the irreversible heat demagnetization rate after treating the magnet at 200° C. for 1 hour, cooling to room temperature and then remagnetizing was less than 1% in the $SiO_2$ infiltration heat-treated magnet in the Example, while it was 1.6% in the present comparative example. It was revealed that the $SiO_2$ precursor solution infiltrated into the magnet only a little less than about 2 mm from the surface of the magnet and this influenced heat demagnetization. Thus, magnetic powder in the center of the magnet was deteriorated by oxidation during heating in an atmosphere, causing the magnet of the present comparative example to have greater irreversible heat demagnetization rate than the magnet of the example.

This result suggests that although the bond magnet of the present comparative example is not inferior to the conventional epoxy bond magnet, its long term reliability may be lower than the conventional epoxy bond magnet.

COMPARATIVE EXAMPLE 5

In the present comparative example, similarly to Example 1, the magnet powder prepared by grinding a thin ribbon of NdFeB was used for producing the rare-earth magnet powder.

A treatment solution for forming a coat film of fluoride of rare-earth metal or alkaline earth metal was prepared as follows.

(1) In the cases of highly water soluble salts, for example, Nd, 4 g of Nd acetate or Nd nitrate was placed in 100 ml of water and dissolved completely using a shaker or an ultrasonic mixer.

(2) Hydrofluoric acid diluted to 10% was slowly added up to an equivalent amount of the chemical reaction generating $NdF_3$.

(3) The solution, in which gel-like precipitates of $NdF_3$ were formed, was stirred using an ultrasonic mixer for 1 hour or longer.

(4) After centrifuging at 4000-6000 rpm, the supernatant was removed, and approximately the same volume of methanol was added.

(5) After stirring the methanol solution containing gel-like $NdF_3$ to prepare homogeneous suspension, the suspension was further stirred for 1 hour or longer using an ultrasonic mixer.

(6) The operations of (4) and (5) described above were repeated 3-10 times until anion such as acetate ion or nitrate ion was no longer detected.

(7) Finally, in the case of $NdF_3$, almost transparent sol-like $NdF_3$ was obtained. For the treatment solution, $NdF_3$ was dissolved in methanol at 1 g/5 mL.

Following method was used to carry out the process for forming the aforementioned magnetic powder of $Nd_2Fe_{14}B$ coated by rare-earth fluoride or alkaline earth metal fluoride film.

The case of $NdF_3$ coat film forming process: $NdF_3$ concentration 1 g/10 mL, semi-transparent sol-like solution.

(1) Fifteen mL of $NdF_3$ coat film forming solution was added to 100 g of the magnetic powder prepared by grinding a thin ribbon of NdFeB and mixed until wetness of all the magnetic powder for rare-earth magnet was confirmed.

(2) Solvent methanol was removed from the magnetic powder for rare-earth magnet, which underwent the $NdF_3$ coat film forming treatment as described in (1), under reduced pressure of 2-5 torr.

(3) The magnetic powder for rare-earth magnet that underwent solvent removal as described in (2) was transferred to a quartz boat, and heated at 200° C. for 30 min and at 400° C. for 30 min under reduced pressure of $1\times10^{-5}$ torr.

(4) The magnetic powder that underwent heat treatment as described in (3) was transferred to a container with a rid made of Macor (Riken Denshi Co., Ltd.) and then heated at 700° C. for 30 min under reduced pressure of $1\times10^{-5}$ torr.

(5) The magnetic powder of $Nd_2Fe_{14}B$ that was coated with a film of rare-earth fluoride or alkaline earth metal fluoride was placed in molds, and a test piece for measuring the magnetic characteristic with a dimension of 10 mm length, 10 mm width and 5 mm thickness and a compression molded test piece for measuring the strength with a dimension of 15 mm length, 10 mm width and 2 mm thickness were produced under the pressure of 16 t/cm$^2$.

(6) The specific resistance of the compression molded test piece of 10 mm length, 10 mm width and 5 mm thickness produced in (5) described above was measured by the 4 pin probe method.

(7) Further, a pulse magnetic field of 30 kOe or greater was applied to the compression molded test piece which was subjected to the specific resistance measurement as described above, and the magnetic characteristic of the compression molded test piece was investigated.

(8) Using a compression molded test piece of 15 mm length, 10 mm width and 2 mm thickness produced in (5) described above, a mechanical bending test was implemented. For the bending test, amples of the compression molded body with a form of 15 mm×10 mm×2 mm was used to evaluate flexural strength by a 3 points flex test with a point distance of 12 mm.

For the magnetic characteristic of the compression molded test piece of 10 mm length, 10 mm width and 5 mm thickness produced in (5) described above, the residual magnetic flux density can be improved by about 20% when compared to a resin containing bond magnet (comparative example 1), and in the demagnetization curve measured at 20° C., the values of residual magnetic flux density and coercivity were almost the same in the molded products before and after $SiO_2$ infiltration and heat treatment. Also, the rate of heat demagnetization after keeping for 1 hour at 200° C. under the atmosphere was 3.0% in the present comparative example, which is almost the same as 3.0% of the $SiO_2$ infiltrated bond magnet in the Example. Further, the irreversible heat demagnetization rate after treating the magnet at 200° C. for 1 hour, cooling to room temperature and then remagnetizing was less than 1% in the $SiO_2$ infiltration heat-treated magnet in the Example, while it was less than 1% in the present comparative example. The results are shown in Table 7.

TABLE 7

Characteristics of materials molded from magnetic powder single body treated with various coat film

| | Type of coat film | Flexural strength (MPa) | Specific resistance (Ωcm) | Residual magnetic flux density (kG) | Coercivity (kOe) | Irreversible heat demagnetization rate (%) |
|---|---|---|---|---|---|---|
| Comparative Example 5 | NdF3 coat film | 2.9 | 0.015 | 6.6 | 12.2 | <1 |
| Comparative Example 6 | MgO type phosphating film | 2.4 | 0.016 | 6.8 | 12.1 | 1.2 |

However, the flexural strength of the compression molded test piece of 15 mm length, 10 mm width and 2 mm thickness produced in (7) was a low value of 2.9 MPa because in the present comparative example $SiO_2$ infiltration was not conducted. It was about 1/15 compared to that of the epoxy bond magnet.

This result indicates that the bond magnet of the present comparative example lacks mechanical strength compared to conventional epoxy bond magnets, and therefore care is needed in this point when the magnet is used powder.

COMPARATIVE EXAMPLE 6

In the present comparative example, similarly to Example 1, the magnetic powder prepared by grinding a thin ribbon of NdFeB was used for producing the rare-earth magnet powder.

The treatment solution which forms a phosphatization film was produced as follows.

Twenty g of phosphoric acid, 4 g of boric acid and 4 g of MgO as the metal oxide were dissolved in 1 L of water. For the surfactant, EF-104 (Tochem Products) was added to achieve 0.1 wt %. As an antirust agent, benzotriazole (BT) was used. This was added to achieve a concentration of 0.04 mol/L.

The formation of a phosphatization film on the magnetic powder of $Nd_2Fe_{14}B$ was implemented by the following process. The composition of the phosphatization solution used is shown in Table 4.

(1) For 100 g of magnetic powder which was obtained by grinding a thin ribbon of NdFeB, 5 mL of phosphatization solution was added. This was mixed until all of the magnetic powder for the rare-earth magnet was confirmed to be wet.

(2) Heat treatment of the magnetic powder for the rare-earth magnet which has had phosphatization film formation treatment according to (1) was conducted at 180° C. for 30 minutes under a reduced pressure of 2-5 torr.

(3) The magnetic powder of $Nd_2Fe_{14}B$ that was treated with the phosphatization process for forming film was placed in molds, and a test piece for measuring the magnetic characteristic with a dimension of 10 mm length, 10 mm width and 5 mm thickness and a compression molded test piece for measuring the strength with a dimension of 15 mm length, 10 mm width and 2 mm thickness were produced under the pressure of 16 t/cm$^2$.

(4) The specific resistance of the compression molded test piece of 10 mm length, 10 mm width and 5 mm thickness produced in (3) described above was measured by the 4 pin probe method.

(5) Further, a pulse magnetic field of 30 kOe or above was applied to the compression molded test piece which was subjected to the specific resistance measurement as described above, and the magnetic characteristic of the compression molded test piece was investigated.

(6) A mechanical bending test was conducted using a compression molded test piece of 15 mm length, 10 mm width and 2 mm thickness produced in (3) described above. A sample of the compression molded piece with a form of 15 mm×10 mm×2 mm was subjected to bending tests to evaluate flexural strength by 3 points bending tests with 12 mm distance between the points.

For the magnetic characteristic of the compression molded test piece of 10 mm length, 10 mm width and 5 mm thickness produced in (3), the residual magnetic flux density can be improved by about 25% when compared to a resin containing bond magnet (comparative example 1), and in the demagnetization curve measured at 20° C., the values of residual magnetic flux density and coercivity were almost the same in the molded products before and after $SiO_2$ infiltration and heat treatment. Also, the rate of heat demagnetization after keeping for 1 hour at 200° C. under the atmosphere was 3.1% in the present comparative example, which is almost the same as 3.0% of the $SiO_2$ infiltrated bond magnet in the Example. Further, the irreversible heat demagnetization rate after treating the magnet at 200° C. for 1 hour, cooling to room temperature and then remagnetizing was less than 1% in the $SiO_2$ infiltration heat-treated magnet of the Example, while it was 1.2% in the present comparative example, which was a little increase but there was no big difference (Table 7).

However, the flexural strength of the compression molded test piece of 15 mm length, 10 mm width and 2 mm thickness produced in (5) described above was a low value of 2.9 MPa because in the present comparative example the $SiO_2$ infiltration was not conducted. It was about 1/20 compared to that of the epoxy bond magnet.

This result indicates that the bond magnet of the present comparative example lacks mechanical strength compared to conventional epoxy bond magnets, and therefore care is needed in this point when the magnet is used.

The present invention is described by the Examples described as above, the magnet according to the present invention has following effects.

1) The capability as a magnet is superior to the conventional resin magnets.

2) In addition to the superior characteristic, it has strength as a magnet. A magnet that is superior in characteristics and in strength not available with the resin magnets is obtained.

The effects of 1) and 2) as described above can be achieved, for example, as follows.

The binding agent solution must infiltrate into 1 μm or smaller gaps between magnetic powder particles which are formed in compression molding of magnetic powder without resin. To achieve this objective, it is required that the viscosity of the binding agent solution is 100 mPa·s or lower, and the wettability of the magnetic powder with the binding agent solution is high. In addition, it is important that adhesiveness between the binding agent and the magnetic powder is high after setting, that mechanical strength of the binding agent is high and that the binding agent is formed continuously.

For the viscosity of the binding agent solution, it depends upon the size of the magnet. However, when the thickness of a compression molded piece is 5 mm or less and gaps between the magnetic powder particles are about 1 μm, the binding agent solution having a viscosity of about 100 mPa·s can be introduced into the gaps between the magnetic powder particles in the central part of the compression molded piece. When the thickness of the compression molded piece is 5 mm or more and gaps between the magnetic powder particles are about 1 μm, for example, in a compression molded piece with about 30 mm thickness, 100 mPa·s viscosity of the binding agent solution is too high to introduce the binding agent solution to the central part of the compression molded piece, and the viscosity of the binding agent solution needs to be 20 mPa·s or lower, preferably 10 mPa·s or lower. This viscosity is lower than that of normal resin by one order or more. To achieve this viscosity, it is necessary to control the amount of hydrolysis of the alkoxy group in alkoxysiloxane that is a precursor of $SiO_2$ and to suppress the molecular weight of alkoxysiloxane. That is, when an alkoxy group is hydrolyzed, a silanol group is generated. However, the silanol group has a tendency of undergoing a dehydration condensation reaction, and the dehydration condensation reaction means higher molecular weight of alkoxysiloxane. Further, since hydrogen bonds are formed between the silanol groups, the viscosity of alkoxysiloxane solution, which is the precursor of $SiO_2$ increases. In particular, it is necessary to control added amount of water against an equivalent amount of the hydrolysis reaction of alkoxysiloxane and the condition of the hydrolysis reaction. It is preferable to use alcohol as a solvent for the binding agent solution because the dissociation reaction of the alkoxy group in alkoxysiloxane is fast. Methanol, ethanol, n-propanol and iso-propanol are preferably used as a solvent alcohol because the boiling point is lower than that of water and the viscosity is low. However, any solvent, which does not permit the increase in the viscosity of the binding agent solution within a few hours and has a boiling point lower than that of water, can be used for the production of the magnet according to the present invention.

For the adhesiveness between the binding agent and the magnetic powder after setting, if the surface of the magnetic powder is covered by natural oxide film, adhesiveness between the surface of the magnetic powder and $SiO_2$ is great, because after heat treatment the product of the $SiO_2$ precursor, which is the binding agent of the present invention, is $SiO_2$. When a rare-earth magnet, which uses $SiO_2$ as the binding agent, is subjected to tension fracture, most of the surface is covered by the magnetic powder or aggregated fracture face of $SiO_2$. On the other hand, when a resin was used as a binding agent, the adhesiveness between the resin and the magnetic powder is generally weaker when compared with that between the surface of the magnetic powder and $SiO_2$. Thus, in a bond magnet using the resin, the surface of the fractured magnet contains both the boundary surface between the resin and the magnetic powder or aggregated fracture face of the resin. Therefore, it is advantageous to use $SiO_2$ as the binding agent to improve the strength of the magnet than to use the resin as the binding agent.

When the content of the rare-earth magnetic powder in a magnet is 75 vol % or greater, a compression molded type rare-earth magnet is to be used, and the strength of the rare-earth magnet after setting of the binding agent is greatly influenced by whether the continuous body of the binding agent is generated after setting. This is because the fracture strength per unit area of the binding agent alone is greater than that of the boundary of adhesion surface. When using a resin such as epoxy resin and the ratio of the resin volume in whole solid mass being 15 vol % or less, the resin in the magnet does not form a continuous body after setting but is distributed like islands due to poor wettability of the resin with the rare-earth magnetic powder. On the other hand, since wettability of the $SiO_2$ precursor with the rare-earth magnetic powder is good as described earlier, the $SiO_2$ precursor spreads continuously on the surface of the magnetic powder, and the precursor is set by the heat treatment to become $SiO_2$ while spreading continuously. When the strength of the binding agent after setting as a material is expressed by the flexural strength, $SiO_2$ has a greater flexural strength than resins by 1-3 order of magnitude. Therefore, the strength of the rare-earth magnet after setting of the binding agent is far greater by using the $SiO_2$ precursor as the binding agent than using a resin.

Next, materials for magnet will be described which are more suitable for the magnet according to the present invention. The rare-earth magnet powder includes a ferromagnetic main phase and other components. In the case of the rare-earth magnet being Nd—Fe—B magnet, the main phase is $Nd_2Fe_{14}B$ phase. Considering for improving the magnetic characteristic, it is preferable that the rare-earth magnet powder is prepared using the HDDR method and a hot plasticity process. The rare-earth magnet powder includes, apart from NdFeB magnets, Sm—Co magnet. Considering the magnetic characteristics of rare-earth magnets to be obtained and production costs, NdFeB magnets are preferred. However, the rare-earth magnet of the present invention is not limited to the NdFeB magnets. Optionally, the rare-earth magnet may contain 2 or more rare-earth magnet powders as a mixture. That is, 2 or more of NdFeB magnets having different composition ratios may be present, and NdFeB magnets and Sm—Co magnets may be present as a mixture.

In the present description, the concept of "NdFeB magnet" includes a form in which a part of Nd or Fe is substituted with other elements. Nd may be substituted with other rare-earth elements such as Dy and Tb. One of these may be used for the substitution or both of them may be used. The substitution can be carried out by controlling the amount of the combination of the material alloy. The coercivity of NdFeB magnets may be improved by such a substitution. The amount of Nd to be substituted is preferably 0.01 atom % or more and 50 atom % or less to Nd. The effect of substitution may possibly be insufficient at less than 0.01 atom %. If it is over 50 atom %, residual magnetic flux density may not be maintained at a high level. Therefore, it is desirable to pay attention to the purpose of the magnet usage.

Fe may be substituted by other transition metals such as Co. Such a substitution can raise the Curie Temperature (Tc) of NdFeB magnets and expand the range of usable temperature. The amount of Fe to be substituted is preferably 0.01 atom % or more and 30 atom % or less to Fe. The effect of substitution may possibly be insufficient at less than 0.01 atom %. If it is over 30 atom %, the coercivity may be lowered greatly. Therefore, it is desirable to pay attention to the purpose of the magnet usage.

The average particle diameter of the rare-earth magnet powder in rare-earth magnets is preferably 1-500 μm. When the average particle diameter of the rare-earth magnet powder is less than 1 μm, the specific surface area of the magnet powder becomes large, which has a big influence on deterioration from oxidation, and the rare-earth magnet using this powder may possibly demonstrate poor magnetic characteristics. Therefore, it is desirable to pay attention to the usage state of the magnet.

On the other hand, when the average particle diameter of the rare-earth magnet powder is 500 μm or larger, the magnet powder is broken down by the pressure applied in the production process, and it is difficult to obtain sufficient electric resistance. In addition, when anisotropic magnets are produced from anisotropic rare-earth magnet powder, it is difficult to align the orientation of the main phase ($Nd_2Fe_{14}B$ phase in NdFeB magnet) in rare-earth magnet powder along the over 500 μm size. The particle diameter of rare-earth magnet powder may be regulated by controlling the particle diameter of material rare-earth magnet powder for producing magnets. The average particle diameter of the rare-earth magnet powder can be calculated from SEM images.

The present invention can be applied to any of the isotropic magnets prepared from isotropic magnet powder, isotropic magnets prepared from anisotropic magnet powder by orienting randomly and anisotropic magnets prepared from anisotropic powder by orienting to a fixed direction. When magnets having a high energy product are needed, anisotropic magnets which are prepared from anisotropic magnet powder oriented in magnetic field are preferably used.

Rare-earth magnet powder is produced by mixing materials according to the composition of the rare-earth magnet to be produced. When NdFeB magnets, in which the main phase is the $Nd_2Fe_{14}B$, are produced, the predetermined amounts of Nd, Fe and B are mixed. Rare-earth magnet powder may be produced by a publicly known method, or commercial products may be used. Such rare-earth magnet powder consists of aggregates of many crystalline particles. It is preferable for improving the coercivity that the average particle diameter of the crystalline particles composing rare-earth magnet powder is below the critical particle diameter of a single magnetic domain. In particular, the average particle diameter of the crystalline particles is preferably 500 nm or below. Here, HDDR method means a method by which the main phase, $Nd_2Fe_{14}B$ compound, is degraded into 3 phases of $NdH_3$, α-Fe and $Fe_2B$ by hydrogenating NdFeB alloy and then $Nd_2Fe_{14}B$ is regenerated by forceful dehydrogenation. UPSET method is a method by which NdFeB alloy that is produced by the ultra rapid cooling method is ground and temporally molded, and then subjected to hot plasticity process.

When a magnet is used under the condition that it is applied with a high frequency magnetic field containing harmonic components, it is preferable that inorganic insulating film is formed on the surface of rare-earth magnet powder. That is, high specific resistance of the magnet is required to reduce eddy current loss in the magnet. Such inorganic insulating film is preferably a film formed by using a phosphating process treatment solution containing phosphoric acid, boric acid and magnesium ion as described in JP-A-10-154613, and it is desirable to use a surfactant and antirust agent together to guarantee homogeneity of the film thickness and the magnetic characteristics of the magnet powder. In particular the surfactant preferably includes perfluoroalkyl surfactants, and the antirust agent preferably includes benzotriazole antirust agents.

Further, a fluoride coat film is desirable as the inorganic insulating film that is to improve insulation and magnetic characteristics of the magnetic powder. The treating solution for forming such fluoride coat film is desirably a solution in which fluoride of rare-earth or fluoride of alkaline earth metal is swollen in a solvent, the main component of which is alcohol, and the fluoride of rare-earth or the fluoride of alkaline earth metal is broken down to the average particle diameter of 10 μm or below and dispersed in the solvent containing an alcohol as a main component, forming a sol. To improve the magnetic characteristics, the magnetic powder, on the surface of which the fluoride coat film is formed, is preferably heat treated under the atmosphere of $1\times10^{-4}$ Pa or below and at the temperature of 600-700° C.

INDUSTRIAL APPLICABILITY

The present invention relates to a magnet in which magnetic materials are bound by a binding agent and a method for producing the same. The magnet according to the present invention is suitable for using as a permanent magnet. The magnet according to the present invention can be applied to fields where conventional magnets are used and is suitable to use, for example, in rotating machines.

It should be further understood by those skilled in the art that although the foregoing description has been made on embodiments of the invention, the invention is not limited thereto and various changes and modifications may be made without departing from the spirit of the invention and the scope of the appended claims.

ADVANTAGES OF THE INVENTION

By using the present invention, magnetic characteristics can be improved in magnets in which magnetic material is bound by a binding agent.

The invention claimed is:

1. A rare-earth magnet comprising a rare-earth magnetic powder bound with a $SiO_2$ binding agent containing an alkoxy group.

2. A rare-earth magnet according to claim 1, wherein the $SiO_2$ binding agent containing an alkoxy group binds the rare-earth magnetic powder with an inorganic insulative film formed at a thickness of 10 microns-10 nm on surfaces thereof.

3. A rare-earth magnet according to claim 2, wherein the $SiO_2$ binding agent is prepared from a $SiO_2$ binding agent solution containing water and at least one $SiO_2$ precursor selected from the group consisting of an alkoxysiloxane, an alkoxysilane, hydrolysates thereof, and dehydration condensation products thereof, and further wherein the $SiO_2$ binding agent is formed with a hydrolyzing catalyst and alcohol if necessary.

4. A rare-earth magnet according to claim 3, wherein the hydrolyzing catalyst is a neutral catalyst.

5. A rare-earth magnet according to claim 4, wherein the neutral catalyst is a stannic catalyst.

6. A rare-earth magnet according to claim 3, wherein a total volume fraction of the alkoxysiloxane, the alkoxysilane, hydrolysates thereof, and dehydration condensation products thereof in the $SiO_2$ binding agent solution is at least 5% by volume and no more than 96% by volume.

7. A rare-earth magnet according to claim 3, wherein water content in the $SiO_2$ binding agent solution is 1/10-1 of a hydrolysis reaction equivalent amount relative to a total amount of the alkoxysiloxane or alkoxysilane.

8. A rare-earth magnet according to claim 2 wherein the inorganic insulative film is a rare-earth fluoride or alkali-earth metal fluoride coat film, or a phosphatized film.

9. A rare-earth magnet according to claim 8, wherein the rare-earth fluoride or alkali-earth metal fluoride coat film contains at least one component selected from the group consisting of $MgF_2$, $CaF_2$, $SrF_2$, $BaF_2$, $LaF_3$, $CeF_3$, $PrF_3$, $SmF_3$, $EuF_3$, $GdF_3$, $TbF_3$, $DyF_3$, $HoF_3$, $ErF_3$, $TmF_3$, $YbF_3$, and $LuF_3$.

10. A rare-earth magnet according to claim 8, wherein the rare-earth fluoride or alkali-earth metal fluoride coat film is prepared by bloating a rare-earth fluoride or an alkali-earth metal fluoride in a solvent having an alcohol as a main component; crushing the rare-earth fluoride or the alkali-earth metal fluoride from a sol state to an average particle diameter of no more than 10 microns; and forming a processing solution by mixing the rare-earth fluoride or the alkali-earth metal fluoride in the solvent having the alcohol as its main component.

11. A rare-earth magnet according to claim 10, wherein the alcohol is methanol, ethanol, n-propanol, or iso-propanol.

12. A rare-earth magnet according to claim 8, wherein the phosphatized film is formed from an aqueous solution containing phosphoric acid, boric acid, and at least one component selected from the group consisting of Mg, Zn, Mn, Cd, Ca, Sr, and Ba.

13. A rare-earth magnet according to claim 8, wherein the phosphatized film is formed from an aqueous solution containing phosphoric acid, boric acid, at least one component selected from the group consisting of Mg, Zn, Mn, Cd, Ca, Sr, and Ba, a surfactant, and an antirust agent.

14. A rare-earth magnet according to claim 13, wherein the surfactant is perfluoroalkyl-based, alkylbenzene sulfonic acid based, dipolar ion based, or polyether-based.

15. A rare-earth magnet according to claim 13, wherein the antirust agent is an organic compound containing at least one of sulfur and nitrogen with a lone-pair of electrons.

16. A rare-earth magnet according to claim 15, wherein the organic compound containing at least one of sulfur and nitrogen with the lone-pair of electrons is a benzotriazole expressed by Chemical Formula 1:

[Formula 1]

Chemical formula 1

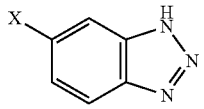

wherein X is any of H, $CH_3$, $C_2H_5$, $C_3H_7$, $NH_2$, OH, and COOH.

* * * * *